US005961301A

United States Patent [19]

Wasserman et al.

[11] Patent Number: 5,961,301

[45] Date of Patent: Oct. 5, 1999

[54] MAGNETIC-DRIVE ASSEMBLY FOR A MULTISTAGE CENTRIFUGAL PUMP

[75] Inventors: Michael O. Wasserman, Chicago; Manfred P. Klein, Highland Park, both of Ill.

[73] Assignee: Ansimag Incorporated, Elk Grove Village, Ill.

[21] Appl. No.: 08/904,143

[22] Filed: Jul. 31, 1997

[51] Int. Cl.[6] ..... F04B 17/00

[52] U.S. Cl. ..... 417/420; 417/365; 417/423.5; 417/424.1

[58] Field of Search ..... 417/420, 365, 417/424.1, 423.5

[56] References Cited

U.S. PATENT DOCUMENTS

| | | | |
|---|---|---|---|
| 982,393 | 1/1911 | Spencer | 417/424.1 |
| 3,116,696 | 1/1964 | Deters . | |
| 3,143,078 | 8/1964 | Gaslow et al. | 103/87 |
| 3,171,355 | 3/1965 | Harris et al. | 103/87 |
| 3,861,825 | 1/1975 | Blom | 415/198 |
| 3,963,371 | 6/1976 | Sieghartner | 415/199 T |
| 4,080,112 | 3/1978 | Zimmermann | 417/420 |
| 4,120,618 | 10/1978 | Klaus | 417/420 |
| 4,135,863 | 1/1979 | Davis et al. | 417/420 |
| 4,226,574 | 10/1980 | Villette | 417/420 |
| 4,802,819 | 2/1989 | Bevington et al. | 415/199.3 |
| 4,850,818 | 7/1989 | Kotera | 417/366 |
| 5,215,448 | 6/1993 | Cooper | 417/423.5 |
| 5,269,664 | 12/1993 | Buse | 417/360 |
| 5,292,284 | 3/1994 | Denk et al. | 464/29 |
| 5,302,091 | 4/1994 | Horiuchi | 417/420 |
| 5,322,421 | 6/1994 | Hansen | 417/420 |
| 5,368,439 | 11/1994 | Piazza | 415/131 |
| 5,413,459 | 5/1995 | Woodall et al. | 415/104 |
| 5,445,494 | 8/1995 | Hanson | 415/107 |
| 5,525,039 | 6/1996 | Sieghartner | 417/32 |
| 5,779,456 | 7/1998 | Bowes et al. | 417/420 |
| 5,856,719 | 1/1999 | De Armas | 310/103 |

FOREIGN PATENT DOCUMENTS

| | | | |
|---|---|---|---|
| 87 08 334 | 10/1987 | Germany | F04D 13/02 |
| 02264193 | 10/1990 | Japan | F04D 13/02 |

*Primary Examiner*—Charles G. Freay
*Assistant Examiner*—Ehud Gartenberg

[57] ABSTRACT

The magnetic-drive assembly has an axial bearing which is strategically located to minimize compressive forces on a primary shaft. The axial bearing functions both as an ordinary thrust bearing and an inefficient impeller for circulating fluid internally within the magnetic-drive assembly. The axial bearing circulates lubricating fluid to a radial bearing to promote bearing longevity. The magnetic-drive assembly has a shaft adjustment mechanism for adjusting the axial orientation of a primary shaft and impellers with respect to a housing. The shaft adjustment mechanism retains its fixed axial orientation despite exposure to vibration and shock produced by the pump.

53 Claims, 17 Drawing Sheets

MAGNETIC-DRIVE ASSEMBLY FOR A MULTISTAGE CENTRIFUGAL PUMP

BACKGROUND OF THE INVENTION

The present invention relates generally to centrifugal pumps; more specifically to multi-stage centrifugal pumps with magnetic-drive assemblies.

Multi-stage centrifugal pumps are often used where single-stage centrifugal pumps do not meet the output pressure or head requirements of the particular application. Most multi-stage centrifugal pumps presently use shaft seals to isolate the pumped fluid from the motor. For example, U.S. Pat. No. 5,445,494, entitled MULTI-STAGE CENTRIFUGAL PUMP WITH CANNED MAGNETIC BEARING and issued to Hanson, discloses a seal for isolating pumped fluid from the motor and magnetic bearings. Shaft seals may leak hazardous or caustic fluids, potentially endangering the safety of pump operators. Periodic inspections of seals are required to reduce unwanted emissions from pumps.

Magnetic-drive, multi-stage pumps may be used to replace entire pumps with seals to reduce unwanted emissions. However, magnetic-drive assemblies cannot be coupled readily to multi-stage centrifugal pumps, designed for traditional seals, without first solving sundry engineering problems. Axial bearing design and axial shaft adjustment are some illustrative examples of engineering problems related to converting multi-stage pumps to magnetic-drive operation.

Many pumps have two axial bearings to meet loads in opposite axial directions as shown in U.S. Pat. No. 5,269,664, entitled MAGNETICALLY COUPLED CENTRIFUGAL PUMP. A thrust collar is located toward the containment shell to absorb axial loads in one direction, while an auxiliary thrust collar is located toward the intake of the pump to absorb axial loads in an opposite direction. The thrust collar is located adjacent to the radial bearing or bushing. One side of the bushing acts as the mating face for the thrust collar. Therefore, the bushing has the dual, stressful role of an axial bearing member and a radial bearing. The bushing is flared or has an exaggerated radial thickness at the bearing interface to increase the reliability of the bearing. The bushing and the thrust collar must use compatible materials.

Some multi-stage pumps do not even have thrust bearings within the pump. Instead, thrust bearings are located in a motor attached to the pump. However, magnetic-drive centrifugal pumps cannot rely on the motor to handle axial loads on the impeller shaft because of the inherent dual shaft design of magnetic-drive pumps.

The shaft and impellers usually need to be axially adjustable for multi-stage pumps. The shaft and impellers are often axially aligned with split, friction collars. The collars are tightened on the shaft. Adjustable collars may shift in axial alignment when exposed to vibration, shock, and axial forces during normal operation of the pump. Some pumps incorporate axial thrust position monitors to measure the relative position of the thrust collar to the thrust bearing. Extreme axial displacement of the thrust bearing from its proper position may cause damage to the impellers if the impellers contact the walls of the internal pump chambers.

Therefore, a need exists for a magnetic-drive assembly which may be coupled to an existing multi-stage centrifugal pump to upgrade the existing multi-stage centrifugal pumps in the field to magnetic-drive operation, without replacing the entire pump. Furthermore, a need exists for a magnetic-drive, multi-stage centrifugal pump which minimizes requisite shaft length through an axially compact magnetic-drive assembly with a reliable, stable axial shaft adjustment mechanism.

SUMMARY OF THE INVENTION

The magnetic-drive assembly has an axial bearing which is strategically located to minimize compressive forces on a primary shaft of a multi-stage pump. The axial bearing functions both as an ordinary thrust bearing and an inefficient impeller for circulating fluid internally within the magnetic-drive assembly. The axial bearing circulates lubricating fluid to a radial bearing to promote bearing longevity. The magnetic-drive assembly has a shaft adjustment mechanism for adjusting the axial orientation of a primary shaft and impellers with respect to a housing. The shaft adjustment mechanism retains its fixed axial orientation despite exposure to vibration and shock produced by the pump.

The magnetic-drive assembly is preferably mounted above an impeller assembly of the multi-stage pump. A majority of the impellers optimally have their impeller intakes facing downward. The axial bearing is located in the magnetic-drive assembly to handle downward thrust generated from the rotation of the impellers. Because of the orientation of the axial bearing toward the top of the pump, the primary shaft is primarily exposed to tensile forces, rather than compressive forces. Therefore, the potential for shaft breakage or bending is greatly reduced by minimizing compressive forces on the primary shaft.

The axial bearing has the dual attributes of an inefficient, partially-open impeller and an ordinary thrust bearing. The axial bearing preferably comprises a thrust ring and an impeller-like face (or bearing face) of a first rotor. The thrust ring is disposed between the impeller-like face and a bearing support. The thrust ring is secured to the bearing support. The bearing support extends radially inward from the pump housing.

The thrust ring is preferably stationary with respect to the radial bearing in the bearing support.

The impeller-like face of the first rotor rotates with respect to the thrust ring. The impeller-like face preferably has alternating radial grooves and lands. The radial grooves of the impeller-like face circulate pumped fluid radially outward and toward a first channel in the bearing support. The first channel directs fluid toward the main flow of the pump. The axial bearing creates a suction which circulates fluid upward through the radial bearing, toward the containment structure. The axial bearing promotes longevity and lubrication of the radial bearing.

The axial adjustment mechanism for the primary shaft preferably includes shaft threads on the end of the primary shaft, an adjustment nut, retention fasteners, and retention bores in the first rotor. The adjustment nut has threads which mate with corresponding shaft threads. The adjustment nut is tightened on the primary shaft enough to align the primary shaft and the associated impellers in a desired axial position. The desired axial position generally signifies that the impellers are approximately centered in their respective discharge chambers. The adjustment nut preferably has a series of holes in its face. The holes have axes which are approximately parallel to the central axis of the adjustment nut. The holes closest to the retention bores are aligned with the retention bores by rotating the adjustment nut. The retention fasteners are placed through the holes and fastened into the retention bores. The shaft is locked in appropriate axial alignment.

The axial adjustment mechanism has reliable holding ability, vibration resistance, and shock resistance. The axial adjustment mechanism has a fine resolution of adjustability determined by the pitch of the shaft threads and the number of holes. The axial profile of the axial adjustment mechanism is minimized by integrating the axial adjustment mechanism into the first rotor. The retention fastener merely has the height of its head projecting axially from a top side of the first rotor. The axial adjustment mechanism optimally features the redundancy of multiple retention fasteners, including a primary fastener and a secondary or back-up fastener. A preferred embodiment of the adjustment mechanism may also be used to remove the first rotor from the primary shaft without removing the primary shaft from the pump.

The magnetic-drive assembly may be used to upgrade an existing multi-stage centrifugal pump to magnetic-drive operation without replacing the entire pump. In addition, a multi-stage centrifugal pump incorporating the magnetic-drive assembly may be manufactured as a complete, new pump.

DETAILED DESCRIPTION

Figure 1A:
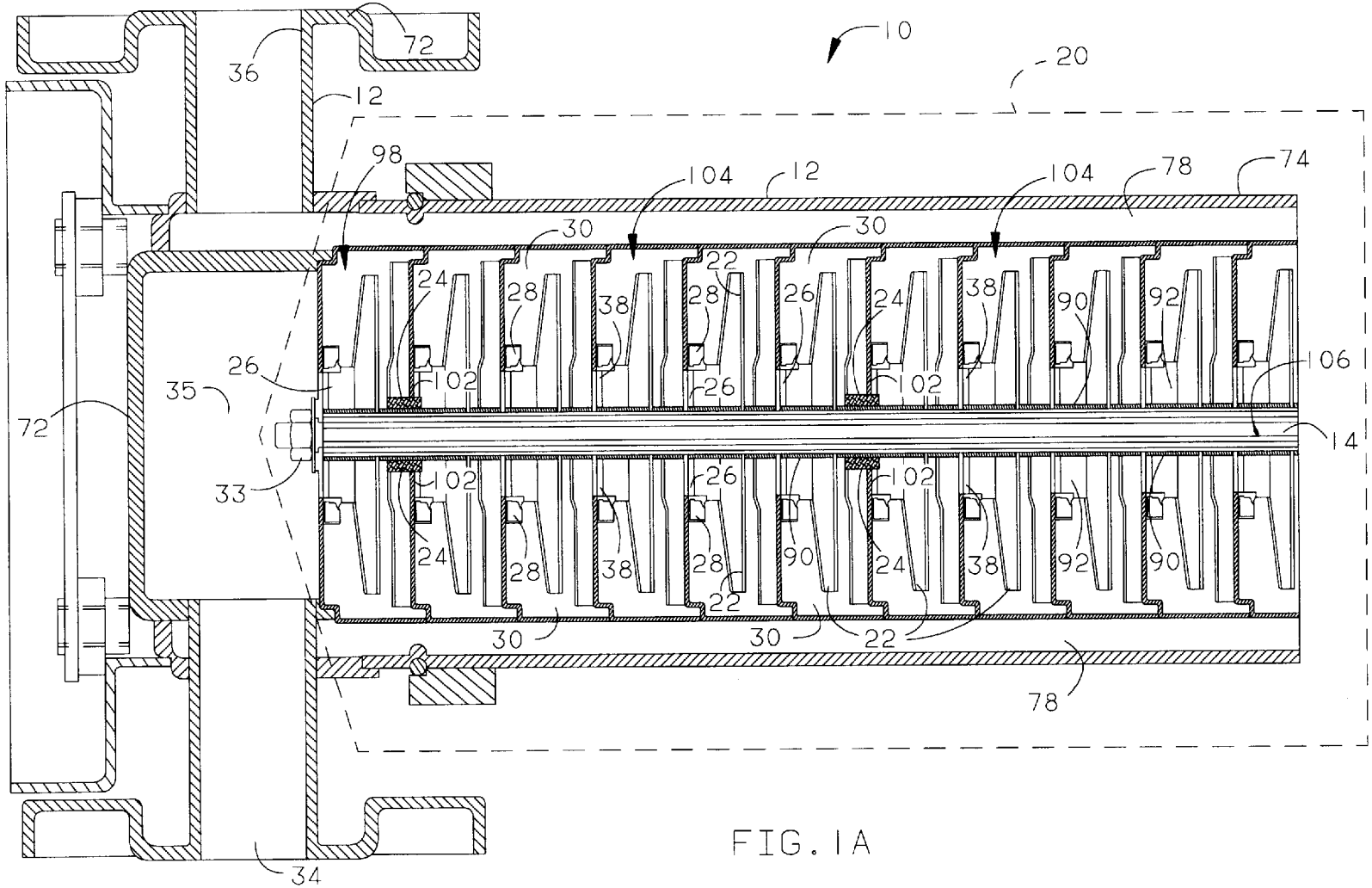
FIG. 1A and FIG. 1B show a cross-sectional view of a multi-stage pump incorporating a first embodiment of the magnetic-drive assembly.
Figure 1B:
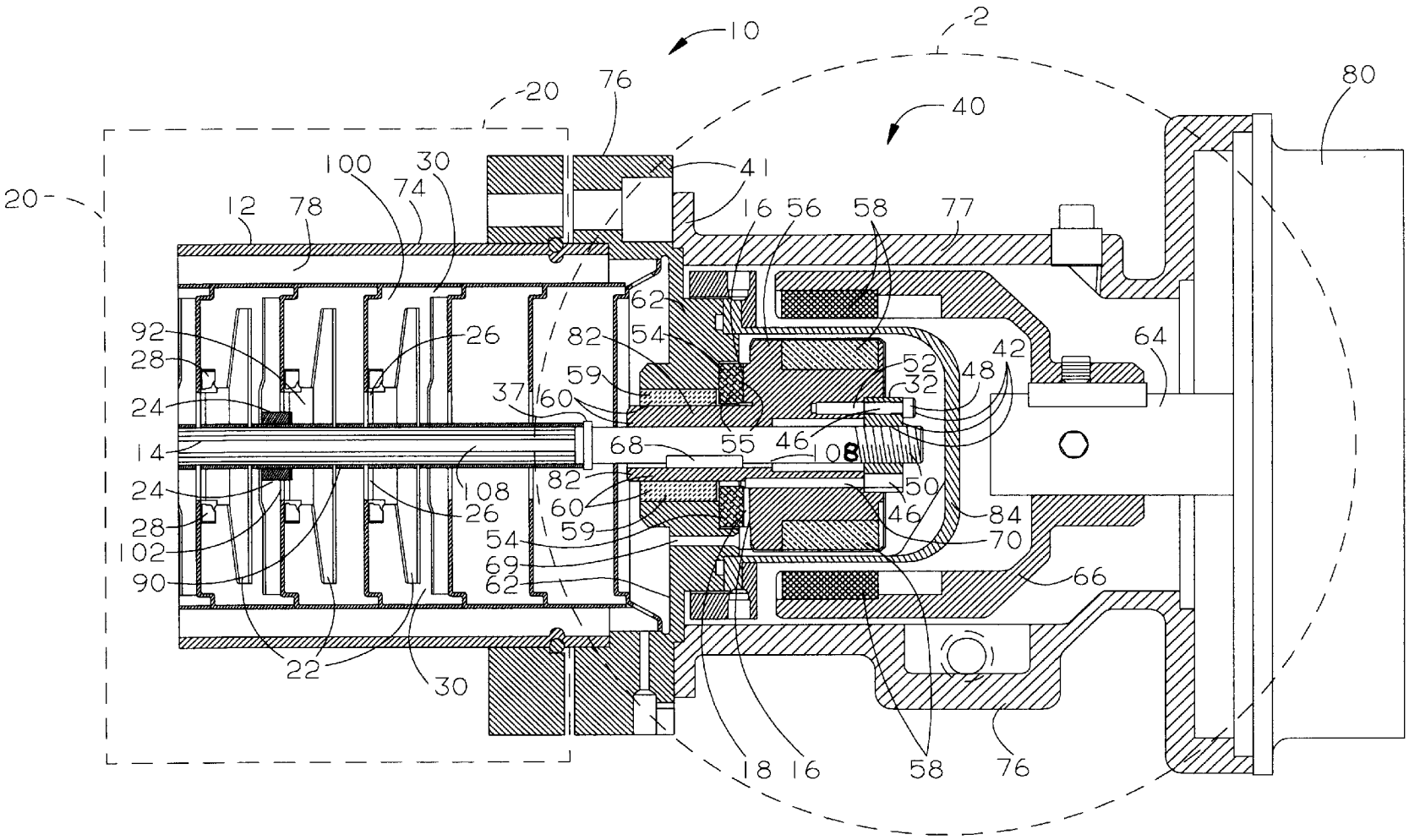

FIG. 1A and FIG. 1B shows an illustrative example of a multi-stage pump 10. The multi-stage pump 10 includes a multi-stage impeller assembly 20 and a magnetic-drive assembly 40. A drive motor 80 is coupled to the multi-stage pump 10 through the magnetic-drive assembly 40.

Multi-stage Impeller Assembly

The multi-stage impeller assembly 20 includes an impeller housing 12, lower radial bearings 24, a primary shaft 14 and impellers 22. The impeller housing 12 contains discharge chambers 30 and intake chambers 38. Lower radial bearings 24 rotatably support the primary shaft 14 within the impeller housing 12. The impellers 22 are located within the discharge chambers 30. The impellers 22 are coupled to the primary shaft 14 so as to propel fluid from an inlet 34 to an outlet 36 when the primary shaft 14 is rotated.

The interior of the impeller housing 12 is divided into discharge chambers 30 and intake chambers 38. The inlet 34 and an outlet 36 of the impeller housing 12 are located near the bottom of the multi-stage pump 10. The inlet 34 and the outlet 36 are optimally configured for in-line operation. The inlet 34 has an inlet volume 35 that fluidly or hydrodynamically communicates with an impeller 22 located in a first stage 98. The outlet 36 fluidly or hydrodynamically communicates with an impeller 22 located in a last stage 100. The impeller housing 12 may be made from multiple casing members for ease of manufacturing. For example, the impeller housing 12 in FIG. 1 has a first casing section 72 and a second casing section 74. The impeller housing 12 is associated with a radial bearing support 102 that supports the lower radial bearings 24.

The lower radial bearings 24 interface with the primary shaft 14 or sleeves mounted on the primary shaft 14. The lower radial bearings 24 are located at suitable axial intervals along the primary shaft 14 to reduce stress on the primary shaft 14 to acceptable levels. The impellers 22 are connected to the primary shaft 14 for mutual rotation with the primary shaft 14. For instance, the primary shaft 14 may be splined and the impeller hubs 92 may have complementary splines, which mate with the primary shaft 14. The impellers 22 have a fixed axial position with respect to the primary shaft 14. The axial position of the impellers 22 may be fixed by placing the impeller hubs 92 in compression between a first retainer 33 (i.e. nut) and a second retainer (i.e. retention ring). The first retainer 33 is located at one end of the primary shaft 14 near the first stage 98 and the second retainer 37 is located toward the opposite side of the primary shaft 14 near the last stage 100. The impellers 22 are spaced apart by spacing sleeves 90 located adjacent to the impeller hubs 92. In general, the impeller hubs 92 and the primary shaft 14 have interlocking shapes to provide mutual rotation of the primary shaft 14 and the impellers 22. The primary shaft 14 is preferably constructed from stainless steel.

The impellers 22 are approximately, axially centered in their discharge chambers 30 by the magnetic-drive assembly 40. Each impeller has a wear ring 28 near its mouth to prevent pumped fluid at discharge pressure from returning to the suction. All or a majority of the impellers 22 are optimally facing the same direction. For example, the impeller intakes 26 of all of the impellers 22 may be facing downward as illustrated in FIG. 1A and FIG. 1B. Downward is left in FIG. 1A and FIG. 1B.

The impeller assembly 20 has multiple pump stages. Each pump stage includes an impeller 22, an intake chamber 38, and a discharge chamber 30. The impellers 22, intake chambers 38, and discharge chambers 30 are arranged in series along the primary shaft 14 such that multiple stages contribute to increasing the output pressure of the fluid. In other words, the discharge chamber 30 of the first stage 98 fluidly communicates with the intake chamber 38 of the second stage or a subsequent stage. The discharge chamber 30 of a previous stage hydrodynamically communicates with the intake chamber 38 of the adjacent succeeding stage. The last stage 100 has a discharge chamber 30 that fluidly communicates to the outlet 36 via a longitudinal duct 78. If the pump has three or more stages as shown in FIG. 1A and FIG. 1B, the stages following the first stage 98 and prior to the last stage 100 are referred to as intermediate stages. The last stage 100 is located closer toward the top of the multistage pump 10 than the other stages. The last stage 100 fluidly communicates with the outlet 36 via the annular, longitudinal duct 78.

Magnetic-drive Assembly

Figure 2:
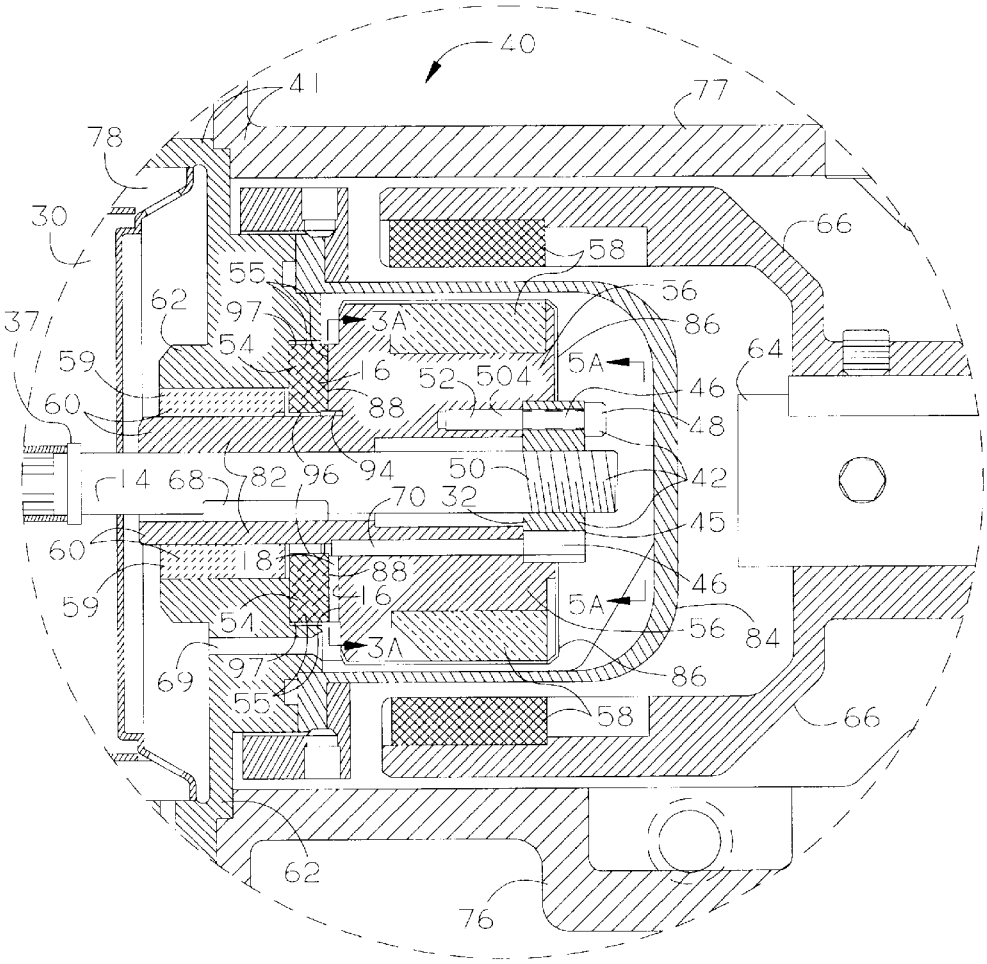
FIG. 2 is an enlarged cross-sectional view of the magnetic-drive assembly shown in FIG. 1A and FIG. 1B.

Referring to FIG. 1A, FIG. 1B, and FIG. 2, the magnetic-drive assembly 40 is preferably located above the multi-stage impeller assembly 20. The magnetic-drive assembly 40 transfers torque from a drive motor 80 to the impellers 22, while isolating the drive motor 80 from the pumped fluid. The magnetic-drive assembly 40 has a magnetic-drive housing 41, a bearing support 62, a containment structure 84, a first rotor 56, a second rotor 66, an upper radial bearing 60, an axial bearing 55, and adjustment means 42 for adjusting and securing the axial alignment of the primary shaft 14 with respect to the housing (i.e. magnetic-drive housing 41).

The magnetic-drive housing 41 houses the magnetic-drive assembly 40. The magnetic-drive housing 41 includes a bearing support 62. The bearing support 62 extends radially within the magnetic-drive assembly 40. The bearing support 62 supports the upper radial bearing 60 and a thrust ring 54 of the axial bearing 55. The axial bearing 55 preferably comprises a combination of the thrust ring 54 and the impeller-like face 16 (or bearing face) of the first rotor 56. The magnetic-drive housing 41 may include a third casing member 76 and a fourth casing member 77.

A containment structure 84 is preferably connected to the magnetic-drive housing 41. The containment structure 84 cooperates with the magnetic-drive housing 41 to confine any pumped fluid to a wet-side of the containment structure 84. The containment structure 84 is preferably constructed from a plastic resin which is reinforced with a reinforcing material, such as carbon fiber or fiberglass. The containment structure 84 may be made from a chemically resistant plastic (i.e. fluoroplastic), fiber-reinforced plastic, fiber-reinforced polymer, plastic composite, polymer composite, or the like. In alternative embodiments, containment structure 84 may be manufactured from metals, alloys, ceramics, plastic composites, or polymer composites. For example, the containment structure 84 may be made from zirconia and coupled to the magnetic-drive assembly 40 by a metallic (i.e. stainless steel) threaded coupling collar.

The first rotor 56 is magnetically coupled to the second rotor 66 through the containment structure 84. The first rotor 56 is located on the wet side of the containment structure 84. The second rotor 66 is located on a dry side of the containment structure 84. The first rotor 56 may be coaxially oriented within the second rotor 66.

The first rotor 56 is coupled to the primary shaft 14 and they rotate together. A key 68 may be used to link the primary shaft 14 to the first rotor 56 as best illustrated in FIG. 2. The key 68 mates with one slot in the primary shaft 14 and another slot in the first rotor 56. The first rotor 56 optimally has a cylindrical projection 82 which axially extends downward from an end of the first rotor 56. The cylindrical projection 82 has the slot for the key 68 and couples torque from the first rotor 56 to the primary shaft 14.

In alternate embodiments, the primary shaft 14 and the first rotor 56 may be coupled by means other than the key. For example, the primary shaft 14 and the first rotor 56 may be coupled by a pin, complementary splines, complementary interlocking shapes of the primary shaft 14 and the first rotor 56, a set-screw, a Woodruff key, matching tapers on the primary shaft 14 and first rotor 56, taper bushings, compression couplings, or the like.

The cylindrical projection 82 is a sleeve-like extension of the first rotor 56. An interior surface of the cylindrical projection 82 mates with the primary shaft 14. The cylindrical projection 82 forms a portion of the upper radial bearing 60. The upper radial bearing 60 comprises a combination of the cylindrical projection 82 and a bushing 59.

The first rotor 56 is magnetically coupled to the second rotor 66 through the containment structure 84. The second rotor 66 is associated with a secondary shaft 64 and rotates with the secondary shaft 64. The second rotor 66 has a cylindrical hollow which surrounds the containment structure 84.

The first rotor 56 and the second rotor 66 optimally contain magnets 58. The magnets 58 may comprise commercially available magnets, rare-earth magnets, or electromagnets for synchronous magnetic coupling to each other. In alternate embodiments the first rotor 56 may be merely a metallic torque ring without magnets for nonsynchronous coupling with the second rotor 66. Likewise, the second rotor 66 may be merely a metallic torque ring without magnets for nonsynchronous coupling with the first rotor 56. A protective sheath 86 is used to enclose the magnets 58 of the first rotor 56. The protective sheath 86 may comprise a thin layer of stainless steel or fluoroplastic to protect the magnets 58 from the pumped fluid.

The secondary shaft 64 is coupled to the second rotor 66 and a drive motor 80. The secondary shaft 64 is closely coupled or far-coupled to the drive motor 80. The drive motor 80 transfers torque to the secondary shaft 64 and the second rotor 66. The rotation of the second rotor 66 imparts rotational movement to the first rotor 56. The first rotor 56 turns the primary shaft 14 and the impellers 22.

Axial Bearing

Referring to FIG. 2, FIG. 3A, FIG. 3B, and FIG. 3C, a first embodiment of the axial bearing 55 comprises a thrust ring 54 and an impeller-like face 16 of the first rotor 56. The thrust ring 54 is preferably stationary with respect to an upper radial bearing 60 in the bearing support 62. A mating face 88 of the thrust ring 54 is located axially adjacent to the impeller-like face 16 or bearing face. The thrust ring 54 accepts a load of downward thrust from the multi-stage impeller assembly 20. The downward thrust originates from the orientation of the impeller intakes 26 and the rotation of the impellers 22. The downward thrust is first transmitted from the impellers 22 through the primary shaft 14 to the impeller-like face 16 or bearing face. The downward thrust is then transmitted from the impeller-like face 16 to the bearing support 62 via the thrust ring 54. The thrust ring 54 is primarily placed in compression between the first rotor 56 and the bearing support 62 during normal operation of the pump. The thrust ring 54 has a material composition selected to meet compressive strength requirements. The axial bearing 55 primarily places the primary shaft 14 under tension and not under compression. Therefore, the lack of the compression reduces the chances of bending or breakage of the primary shaft 14.

The primary shaft 14 may be divided into a first portion 106 and a second portion 108. The first portion 106 includes the axial length of the primary shaft 14 located within the magnetic-drive assembly 40. The second portion 108 includes the axial length of the primary shaft 14 located in the impeller housing 12. The second portion 108 of the primary shaft 14 is predominately exposed to tensile forces from downward axial forces. The second portion 108 has a greater axial length than the first portion 106 for the multi-stage pump.

During normal operation of the pump, the axial forces are primarily described as downward or forward thrust. Forward thrust is caused by the suction created at the impeller intake 26 of the impellers 22 and the discharge pressure pushing on the opposite side of the impellers 22. The magnetic-drive assembly 40 preferably has single axial bearing 55 to handle forward or downward thrust.

If gas or air is trapped in the pump fluid or abnormal pump operation occurs, reverse or upward thrust vibrations may occur. No axial bearing 55 is required for upward thrust because the operational thrust is downward during normal pump operating conditions and the weight of the internal pump components provide a resultant downward force.

The weight of the internal components and the orientation of the impellers 22 comprises upward thrust counteracting means for counteracting upward thrust and movement of the primary shaft 14 upward. The upward thrust counteracting means includes the weight of internal components such as the first rotor 56, the primary shaft 14, and the impellers 22. Upward thrust counteracting means may include the downward thrust invariably generated during normal pump operation from the downward orientation of the impeller intakes 26. An optional thrust bearing for reverse thrust loads may be located adjacent to one of the lower radial bearings 24 of the multi-stage impeller assembly 20, if the orientation of the pump is changed with respect to gravity, or if pump specifications so dictate.

The thrust ring 54 is secured to the bearing support 62. The thrust ring 54 preferably, frictionally engages or interlocks with the bearing support 62 to inhibit rotational movement of the thrust ring 54. For example, one face of the thrust ring 54 or the periphery of the thrust ring 54 may have a recess that mates with an opposite, complementary projection in the bearing support 62, or vice versa.

Figure 3A:
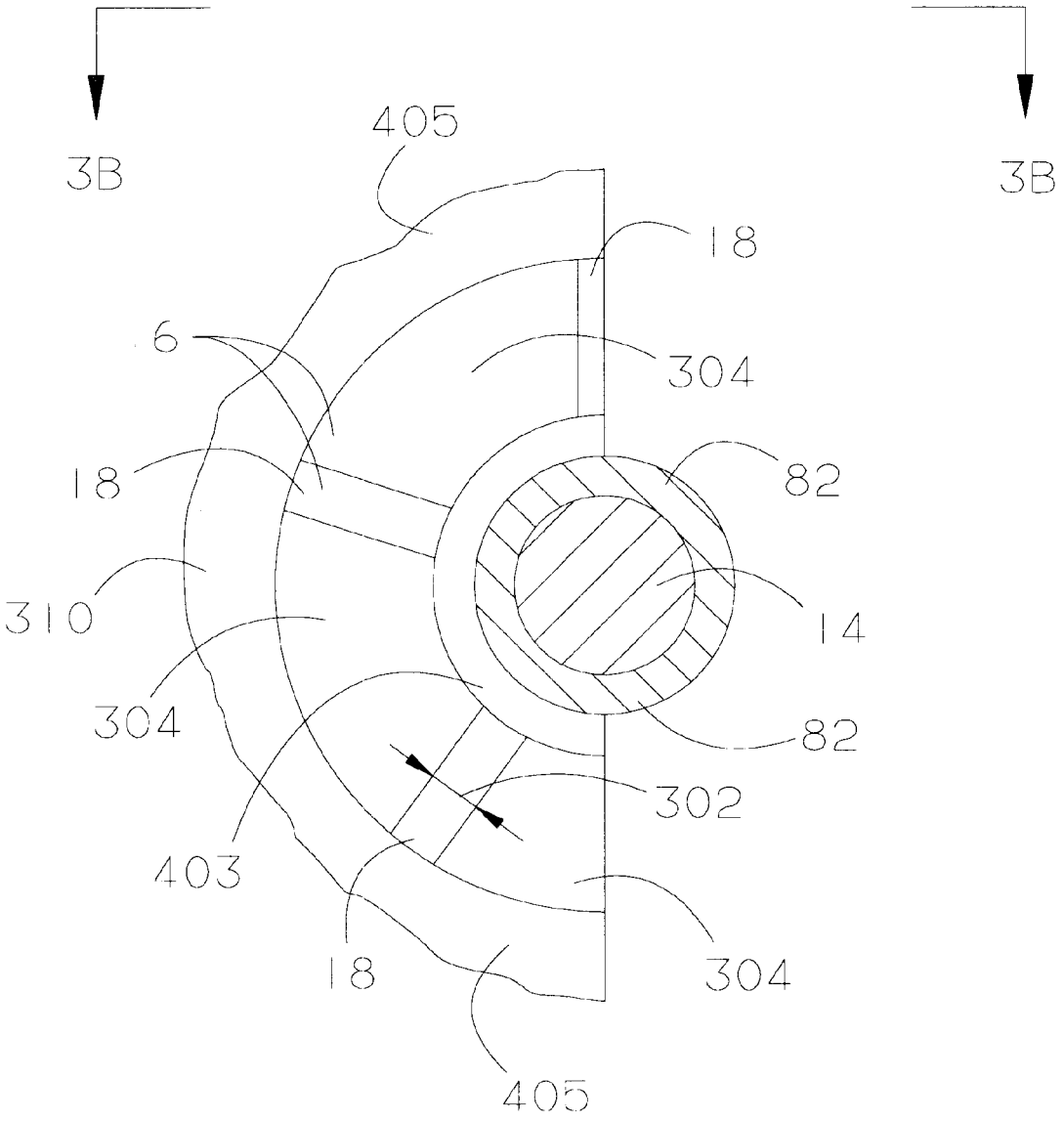
FIG. 3A illustrates an impeller-like face of the first rotor along reference line 3A—3A of FIG. 2.
Figure 3B:
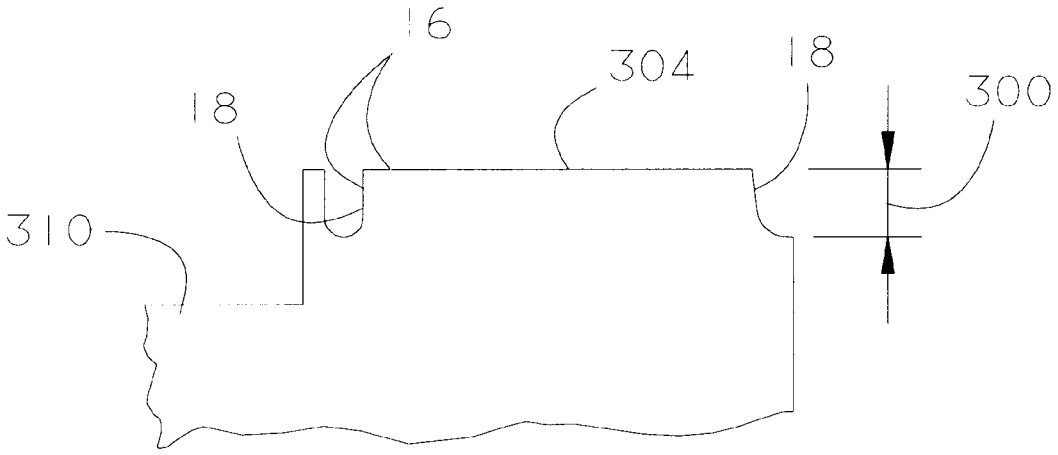
FIG. 3B illustrates a cross-sectional view of the impeller-like face along reference line 3B—3B of FIG. 3A.
Figure 3C:
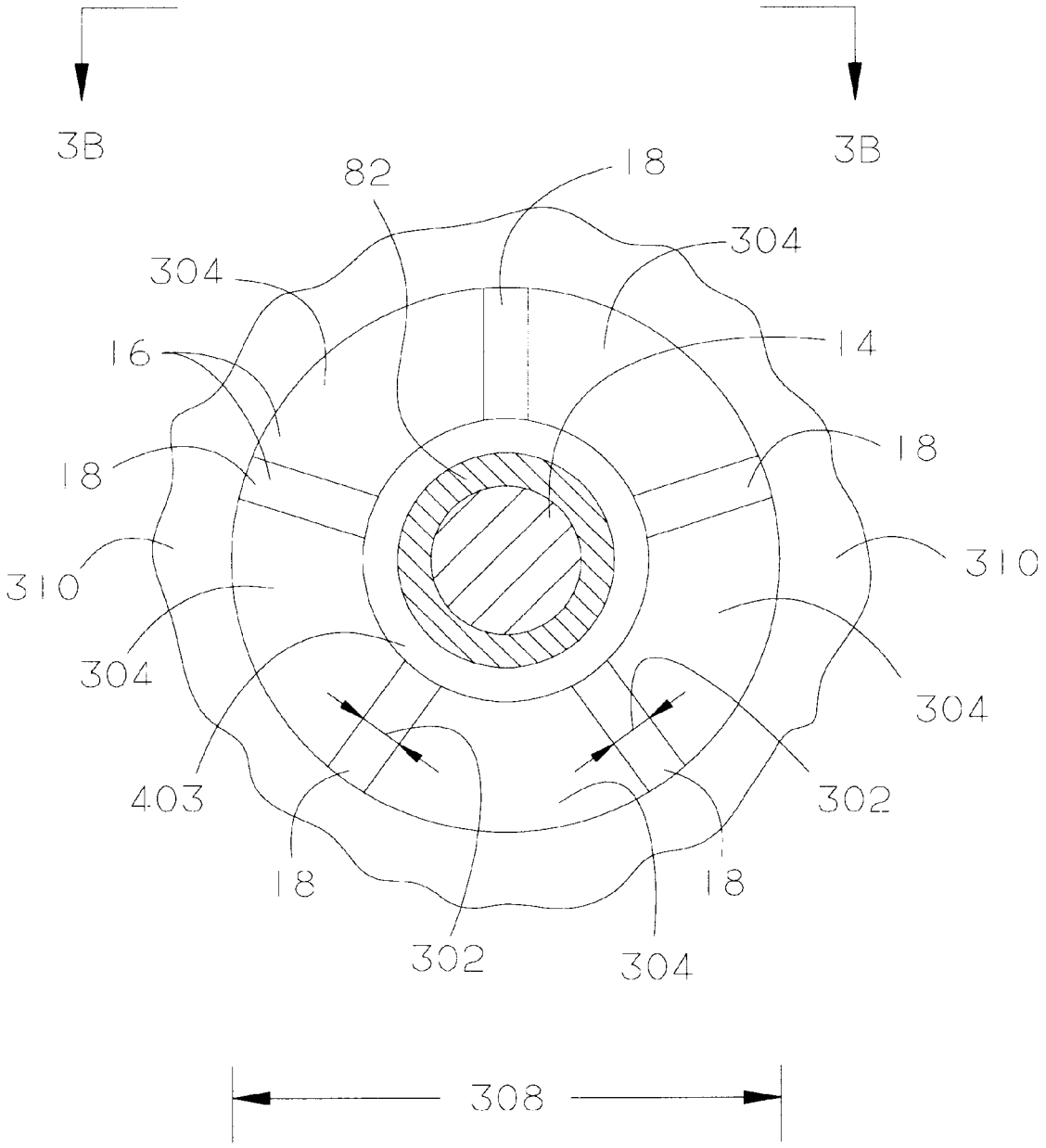
FIG. 3C illustrates the entire impeller-like face of the first rotor, as opposed to the cut-away portion of the impeller-like face shown in FIG. 3A.

The impeller-like face 16 of the first rotor 56 rotates with respect to the thrust ring 54. The impeller-like face 16 preferably has alternating radial grooves 18 and lands 304 as best illustrated in FIG. 3A, FIG. 3B, and FIG. 3C. In other words, a longitudinal portion of the radial grooves 18 extends radially along the impeller-like face 16. In FIG. 2, the apparent gap between the impeller-like face 16 and the thrust ring 54 merely depicts a longitudinal cross section of a radial groove 18. The lands 304 are the mating surface of the impeller-like face 16.

The radial grooves 18 circulate pumped fluid radially outward from an annular inlet region 403 to an annular outlet region 405. From the annular outlet region 405 the fluid flows partially through a first channel 69 in the bearing support 62. The impeller-like face 16 places a suction on the fluid through the upper radial bearing 60 to increase lubrication to the upper radial bearing 60. The internal fluid circulation paths in the pump are later described in conjunction with FIG. 4.

The thrust ring 54 is preferably made from carbon graphite. Alternatively, the thrust ring 54 may be constructed of plastics, polymers, fiber-filled polymers, fiber-filled plastics, plastic composites, polymer composites, or ceramics (i.e. silicon carbide). The base of first rotor 56 may be made from stainless steel. However, the impeller-like face 16 or the lands 304 are optimally coated with a chrome oxide coating. In alternate embodiments, the impeller-like face 16 or the first rotor 56 may be made partially from other materials such as plastics, ceramics, polymers, polymer composite, plastic composites, fiber-reinforced plastic, fiber-reinforced plastics, ceramics, or the like.

The impeller-like face 16 has a series of alternating lands 304 and radial grooves 18. The impeller-like face 16 is a bearing face that has the hydrodynamic characteristics of an inefficient impeller, while preserving the functionality of a thrust bearing. The aggregate surface area of the lands 304 is selected to be equal to or greater than the minimum surface area required to meet the estimated maximum axial load requirements generated by the impeller assembly 20. Meanwhile, the dimensions of the radial grooves 18 are selected to convey adequate volumes and flow of fluid to the upper radial bearing 60 without appreciably sacrificing the load-carrying capability of the axial bearing 55. As the aggregate volume of the radial grooves 18 is increased, the impeller-like face 16 is able to circulate a greater volume of fluid. However, as the groove width 302 of each radial grooves 18 increases, the load-carrying capability of the axial bearing 55 declines. Under ideal conditions, the axial bearing 55 would provide adequate fluid flow to the upper radial bearing 60 while operating in the mixed film lubrication regime.

The relative sizes of the impeller-like face 16 and the radial grooves 18 may be determined based on the best efficiency point of the pump and the number of pump stages. As an illustrative example for a multi-stage pumps with a best efficiency point of ten to thirty gallons per minute and having between ten and fifteen stages, the diameter 308 of the impeller-like face 16 may be approximately two inches to three inches with four to six radial grooves in the impeller-like face 16. Each of the radial grooves 18 has groove width 302 of approximately one-quarter inch and a groove depth 300 of approximately one-quarter inch for the illustrative example. Carbon graphite is preferred for the thrust ring 54, while chrome oxide is preferred for the first rotor 56. As illustrated in FIG. 3C, the impeller-like face 16 has five radial grooves 18 with U-shaped, semi-elliptical or semi-circular cross-sections. In practice, the impeller-like face 16 may have virtually any number of radial grooves 18. However, four to six grooves are preferred. The radial grooves 18 are preferably spaced at equal angular intervals in the impeller-like face 16. The groove width 302 of each radial groove 18 preferably, approximately equals the maximum groove depth 300. The impeller-like face 16 has an inner radial boundary and an outer radial boundary.

In practice, numerous variations of the impeller-like face 16 are possible. For example, the cross sections of the radial grooves 18 could be rectangular or V shaped, instead of being curved. The first rotor 56 optionally has annular flange 310 adjacent the impeller-like face 16. The annular flange 310 is recessed with respect to the impeller-like face 16. The annular flange 310 is not required. The annular flange 310 may be eliminated where necessary to increase the diameter 308 of the impeller-like face 16 to increase axial load-carrying capability of the axial bearing 55.

Lubrication of the Radial Bearing

Figure 4:
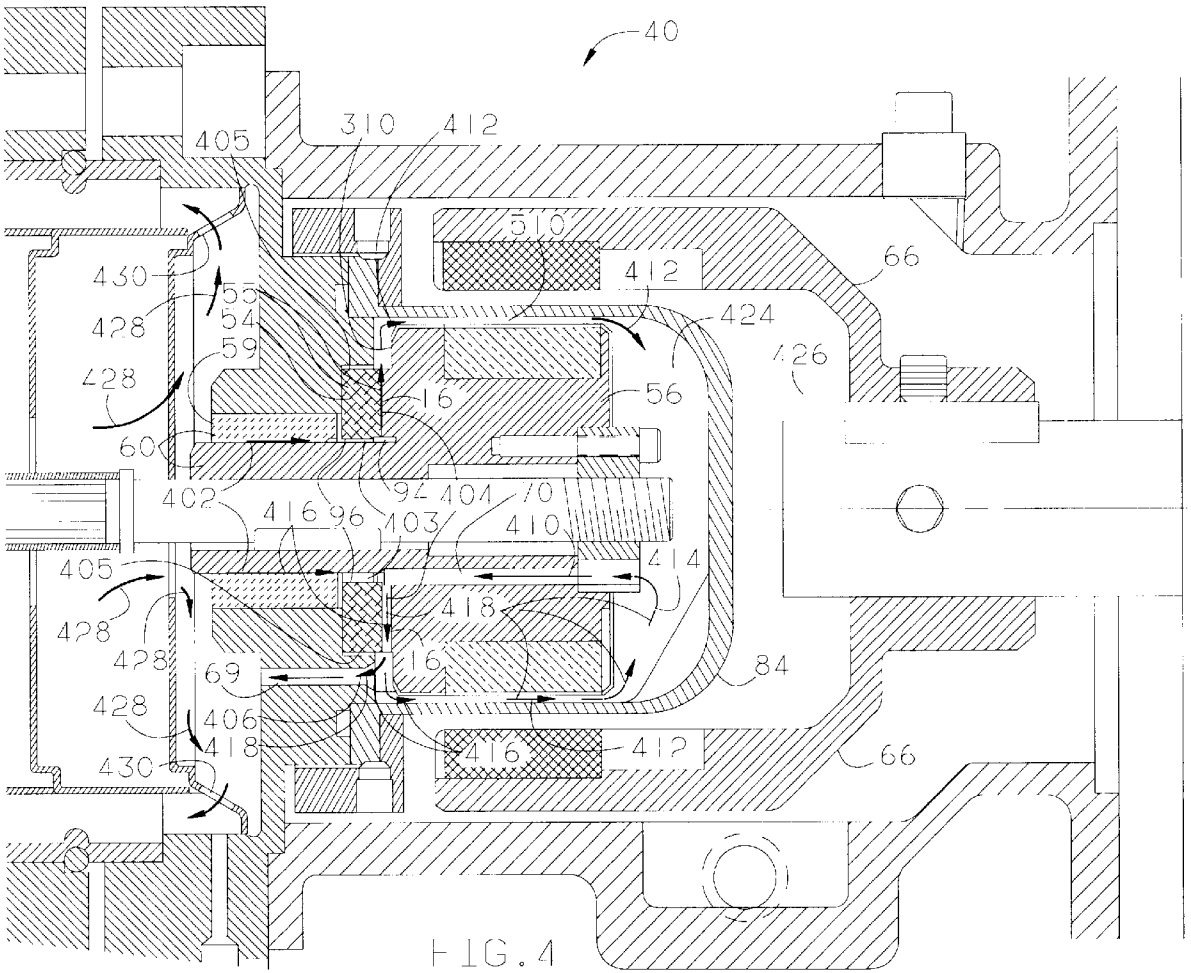
FIG. 4 is a cross-sectional view of the first embodiment of the magnetic-drive assembly showing various internal fluid paths, including the flow of fluid that lubricates the radial bearing.

Referring to FIG. 4, various internal circulation channels are illustrated, including a first channel 69, a second channel 70, and a radial gap 510. The first channel 69 is located in the bearing support 62. The second channel 70 is located in the first rotor 56. The first channel 69 and the second channel 70 are generally, axially extending channels with substantially cylindrical cross-sections. The first channel 69 connects the discharge region to the magnetic-drive assembly region. The first channel 69 and second channel 70 are used to circulate fluid for lubrication of internal pump parts. The radial gap 510 between the first rotor 56 and the containment structure 84 is minimal to maximize magnetic coupling forces between the magnets 58. The radial gap flow 412 is limited by the hydrodynamic resistance associated with the radial gap 510.

An annular inlet region 403 and an annular outlet region 405 are adjacent to the axial bearing 55. The annular inlet region 403 provides a fluidic entrance to the radial grooves 18. The annular outlet region 405 provides a fluidic exit to the radial grooves 18. The annular inlet region 403 may be defined by an annular depression 94 or indentation in the first rotor 56. Alternatively, the annular inlet region 403 has a boundary defined by a cylindrical inner surface 96 of the thrust ring 54. The annular outlet region 405 may have boundaries defined by a cylindrical outer surface 97 of the thrust ring 54, the bearing support 62, and the annular flange 310 of the first rotor 56.

The fluid on a wet side 424 of the magnetic-drive assembly 40 is pressurized by the impeller assembly 20 and the fluid is circulated by the axial bearing 55. The fluid on the wet side 424 of the containment structure 84 in the magnetic-drive assembly 40 is approximately, uniformly at discharge pressure, without considering the affects of the axial bearing 55.

The direction of a main flow 428 is shown by the arrows in FIG. 4. The main flow 428 represents the output of the pump. The main flow 428 leaves the last discharge chamber 30 and travels radially outward toward the longitudinal duct 78. The fluid passes through outlet ports 430 into the longitudinal duct 78. The longitudinal duct 78 is an annular shaped conduit connected to the outlet 36. A portion of the main flow 428 is deflected off the front of the upper radial bearing 60 and bearing support 62. The deflected fluid is routed through the longitudinal duct 78 and to the outlet 36. The main flow 428 alone generally provides inadequate lubrication to the upper radial bearing 60 and the axial bearing 55.

The impeller-like face 16 or bearing face of the first rotor 56 circulates fluid in two internal fluid paths: a primary internal fluid path 416 and a secondary internal fluid path 418. The arrows in FIG. 4 indicate the principle direction of fluid flow in the primary internal fluid path 416 and the secondary internal fluid path 418. The primary internal fluid path 416 lubricates the upper radial bearing 60. The secondary internal fluid path 418 provides a source of fluid for lubricating the axial bearing 55. The primary internal fluid path 416 and the secondary internal fluid path 418 may overlap in certain internal regions of the magnetic-drive assembly 40.

The primary internal fluid path 416 starts at the radial bearing flow 402 as fluid is pulled toward the impeller-like face 16 in an upward, axial direction. The radial bearing flow 402 has a substantially annular shape around the upper radial bearing 60. The radial bearing flow 402 travels in an annular gap between the bushing 59 and the cylindrical projection 82 of the first rotor 56. The radial bearing flow 402 may be enhanced by using a radial bearing with spiral grooves. The impeller-like face 16 receives fluid from the annular inlet region 403 near the upper radial bearing 60. The pumping region flow 404 is expelled radially outward to the annular outlet region 405 from the impeller-like face 16. The fluid in the annular output region 405 is pressurized from the rotation of the impeller-like face 16. The fluid in the annular output region 405 induces a first channel flow 406 and a radial gap flow 412. The first channel flow 406 through the first channel 69 in the bearing support 62 is axially downward. The first channel flow 406 empties into the main flow 428.

The secondary internal fluid path 418 starts at a second channel flow 410. The second channel flow 410 travels axially downward through the second channel 70 in the first rotor 56. The second fluid channel flow 410 moves axially toward the annular inlet region 403. The second channel 70 preferably has a cylindrical cross-section. The impeller-like face 16 places a suction on the fluid in the annular inlet region 403 and the second channel 70. The pumping region flow 404 expels the fluid to the annular outlet region 405. The fluid is pressurized in the annular output region 405 by the rotation of the impeller-like face 16. The fluid in the annular output region 405 induces a first channel flow 406 and a radial gap flow 412.

The fluid is distributed axially downward through the first channel 69 and axially upward and annularly within the radial gap 510. The return flow 414 is located in the area between the containment structure 84 and a top side of the first rotor 56. The return flow 414 moves into the second channel 70.

The primary internal fluid path 416 and secondary internal fluid path 418 contribute to the longevity and the lubrication of the upper radial bearing 60 and the axial bearing 55. If the containment shell 84 is non-metallic and synchronous magnetic coupling is used, the lubricating fluid is not heated by eddy currents - further extending bearing life.

In alternate embodiments, the second channel flow 410 does not necessarily need to extend through the adjustment nut 32. For example, the dimensions of the adjustment nut 32 relative to the second channel 70 may be selected to place the second channel 70 outside of the diameter of the adjustment nut 32. In yet other embodiments, the second channel 70 may be curved radially outward as necessary to avoid a fluid path through the adjustment nut 32.

Axial Adjustment Mechanism

Figure 5A:
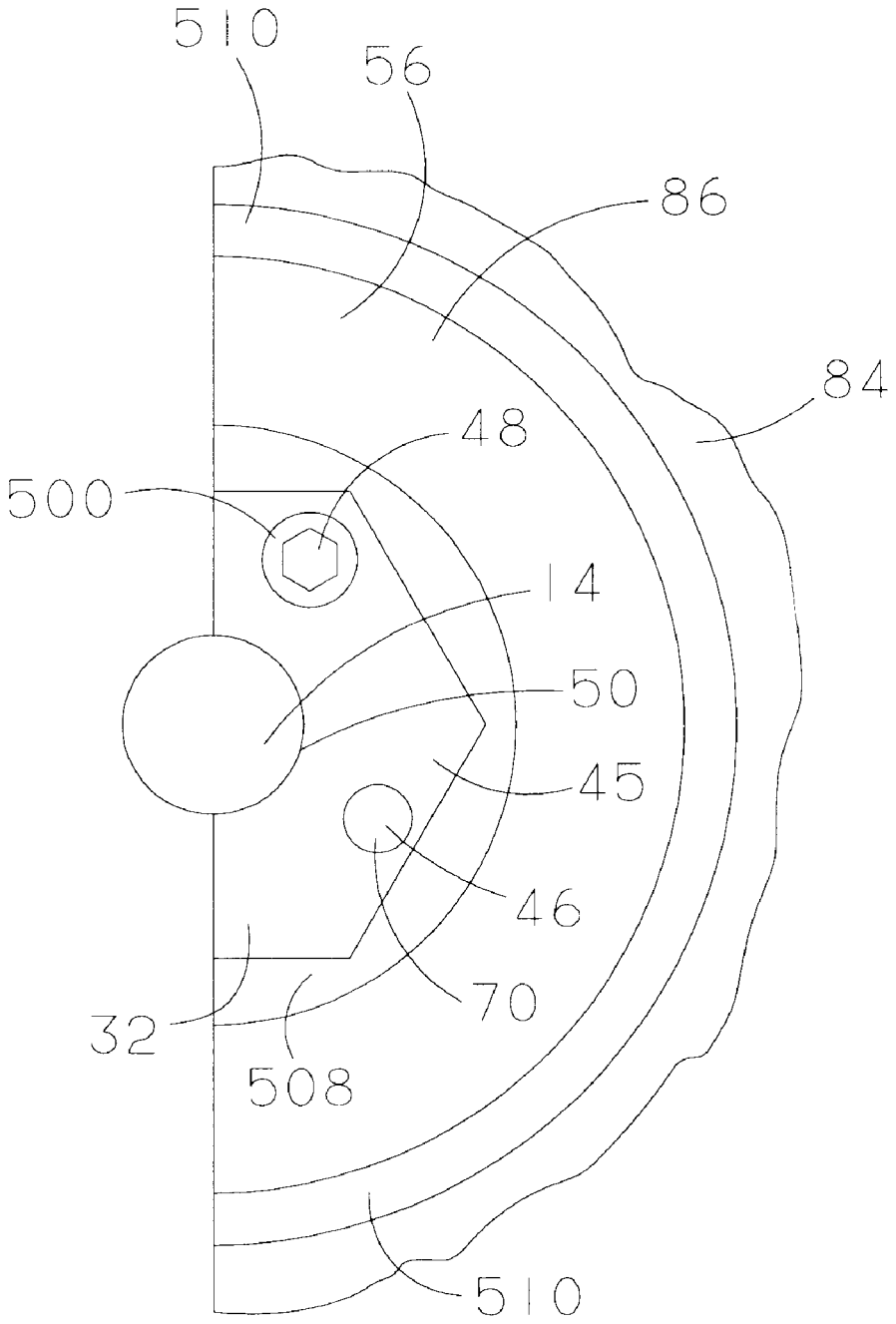
FIG. 5A shows a first embodiment of the axial adjustment mechanism for the primary shaft along reference line 5A—5A of FIG. 2.
Figure 5B:
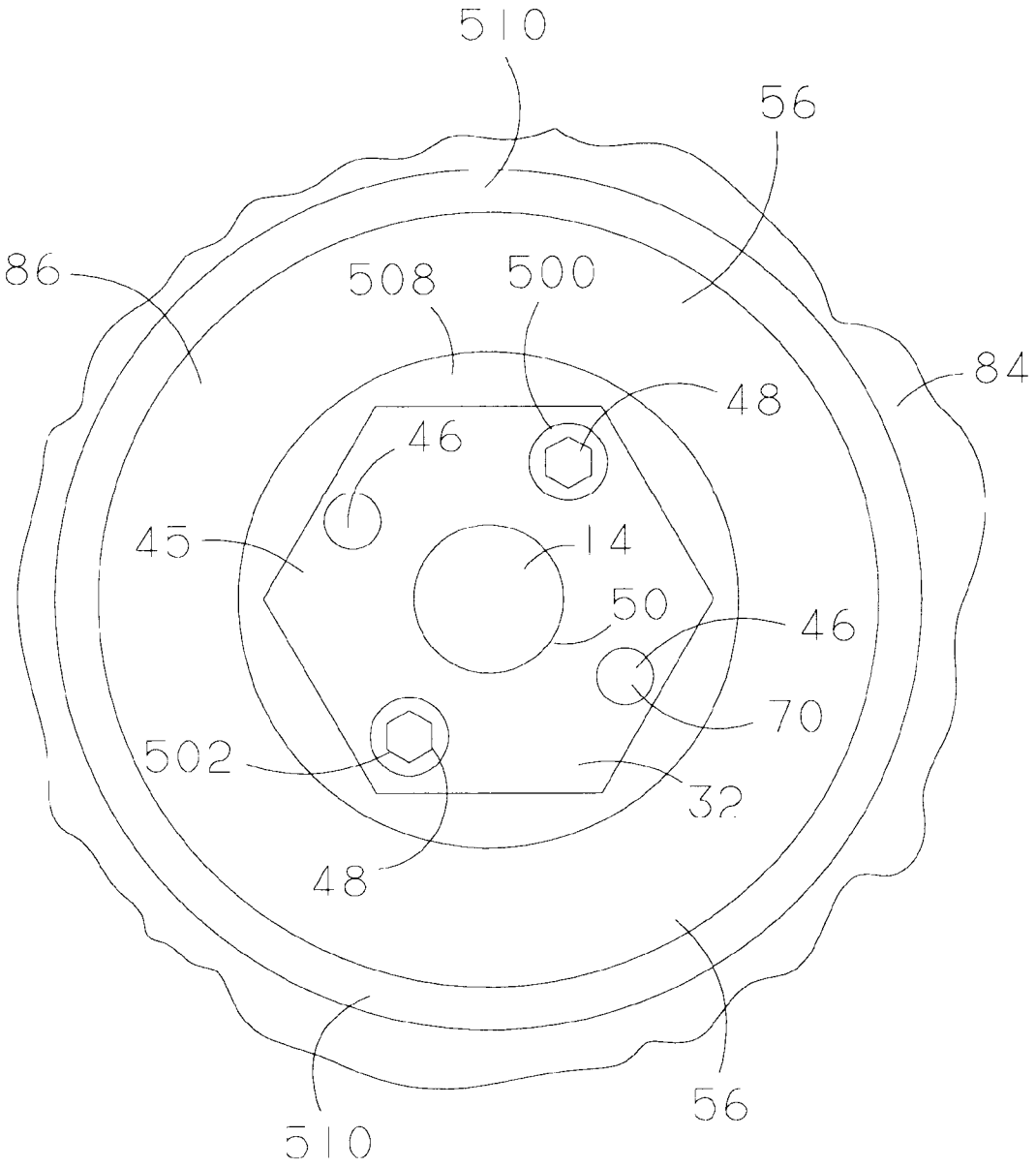
FIG. 5B illustrates an entire top side of the first rotor, as opposed to the cutaway portion of the first rotor shown in FIG. 5A.

FIG. 2, FIG. 5A and FIG. 5B show a first embodiment of the axial adjustment mechanism 42. The axial adjustment mechanism 42 is also referred to as the adjustment means 42 for adjusting and securing the axial alignment of the primary shaft 14 with respect to the housing. The axial adjustment means 42 secures the axial alignment of the primary shaft 14 with respect to the housing. The housing shall include the impeller housing 12, the magnetic-drive housing 41, or both.

The first embodiment of the axial adjustment mechanism 42 for the primary shaft preferably includes shaft threads 50 on the end of the primary shaft 14, an adjustment nut 32, retention fasteners 48, and retention bores 52 in the first rotor 56. The adjustment nut 32 may comprise a square nut, a hexagonal nut, a circular knob with a knurled periphery, or the like. The adjustment nut 32 has threads which mate with corresponding shaft threads 50. The adjustment nut 32 has a series of holes 46 in its face. The retention fasteners 48 are placed through the holes 46 and into the retention bores 52.

The retention bores 52 are preferably tapped, threaded, or fitted with inserts.

The adjustment nut 32 has threads which mate with corresponding shaft threads 50 on the end of the primary shaft 14. The adjustment nut 32 is tightened on the primary shaft 14 enough to align the primary shaft 14 and the associated impellers 22 in a desired axial position. The impellers 22 are coupled to the primary shaft 14 and have a fixed orientation with respect to the primary shaft 14. The desired axial position generally signifies that the impellers 22 are approximately centered in their respective discharge chambers 30.

The adjustment nut 32 has a series of holes 46 in its face 45 or side. In a preferred embodiment, the adjustment nut 32 has four holes 46 spaced at approximately ninety degree intervals from each other. However, it is to be understood that various numbers of holes 46 spaced at various angular intervals may be used to practice the present invention. The holes 46 have axes which are approximately parallel to the central axis of the adjustment nut 32 or a longitudinal axis of the primary shaft 14. The holes 46 closest to the retention bores 52 are aligned with the retention bores 52 by rotating the adjustment nut 32. Thus, any departure from the desired axial position is minimized while aligning the holes 46 with the retention bores 52.

The retention fasteners 48 are placed through the holes 46 and into the retention bores 52. The primary shaft 14 is locked in appropriate axial alignment. The retention fasteners 48 may be Alan-head bolts, hexagonal head bolts, rivets, snap-fit fasteners, or the like. The retention bores 52 are preferably tapped or modified in other ways to receive the corresponding retention fasteners 48. Inserts may be used in the retention bores 52 to receive the corresponding retention fasteners 48.

The adjustment means 42 preferably, redundantly secures the orientation of the adjustment nut 32 upon the primary shaft 14. As shown in FIG. 2, FIG. 5A and FIG. 5B, the adjustment means 42 uses multiple retention fasteners 48, including a primary fastener 500 and a secondary fastener 502. The secondary fastener 502 is a back-up for the primary fastener 500. The primary fastener 500 engages a first bore 504 in the first rotor 56. The secondary fastener 502 engages a second hole in the first rotor 56. The first bore 504 and the second bore optimally have threads associated with them for receiving the primary fastener 500 and the secondary fastener 502, respectively. The primary fastener 500 and the secondary fastener 502 are preferably oriented so as to balance the first rotor 56. For example, the primary fastener 500 and the secondary fastener 502 may be spaced approximately one-hundred and eighty degrees apart with respect to a top side of the first rotor 56.

The axial adjustment mechanism 42 for the primary shaft 14 has reliable resistance to axial movement from vibration and axial shock. The axial adjustment mechanism 42 has a fine resolution of adjustability determined by the pitch of the threads on the end of the primary shaft 14 and the number of holes 46. The resolution of adjustability is increased by making the pitch of the shaft threads 50 finer or by decreasing the angular separation between the holes 46.

The axial profile of the axial adjustment mechanism 42 is minimized by integrating the axial adjustment mechanism 42 into the first rotor 56. The retention fastener 48 merely has the height of the head or fastener portion projecting axially from the first rotor 56. The first rotor 56 may have a cylindrical recess 508 on a top side of the first rotor 56. The cylindrical recess 508 is larger in diameter than the adjustment nut 32. The cylindrical recess 508 further reduces the axial profile of the adjustment mechanism 42 by allowing the adjustment nut 32 to be seated or placed within the cylindrical recess 508.

In alternate embodiments, only one retention fastener may be used to secure the adjustment nut. However, if only one retention fastener is used, the first rotor must be balanced by compensating for the weight distribution of the sole retention fastener. In general, material would be removed from the first rotor near the part of the first rotor having the retention fastener. Alternatively, ballast weight would be added to an opposing portion of the first rotor. The opposing portion is located approximately opposite to the part of the first rotor, which has the single retention fastener.

Using the Axial Shaft Adjustment

Figure 6A:
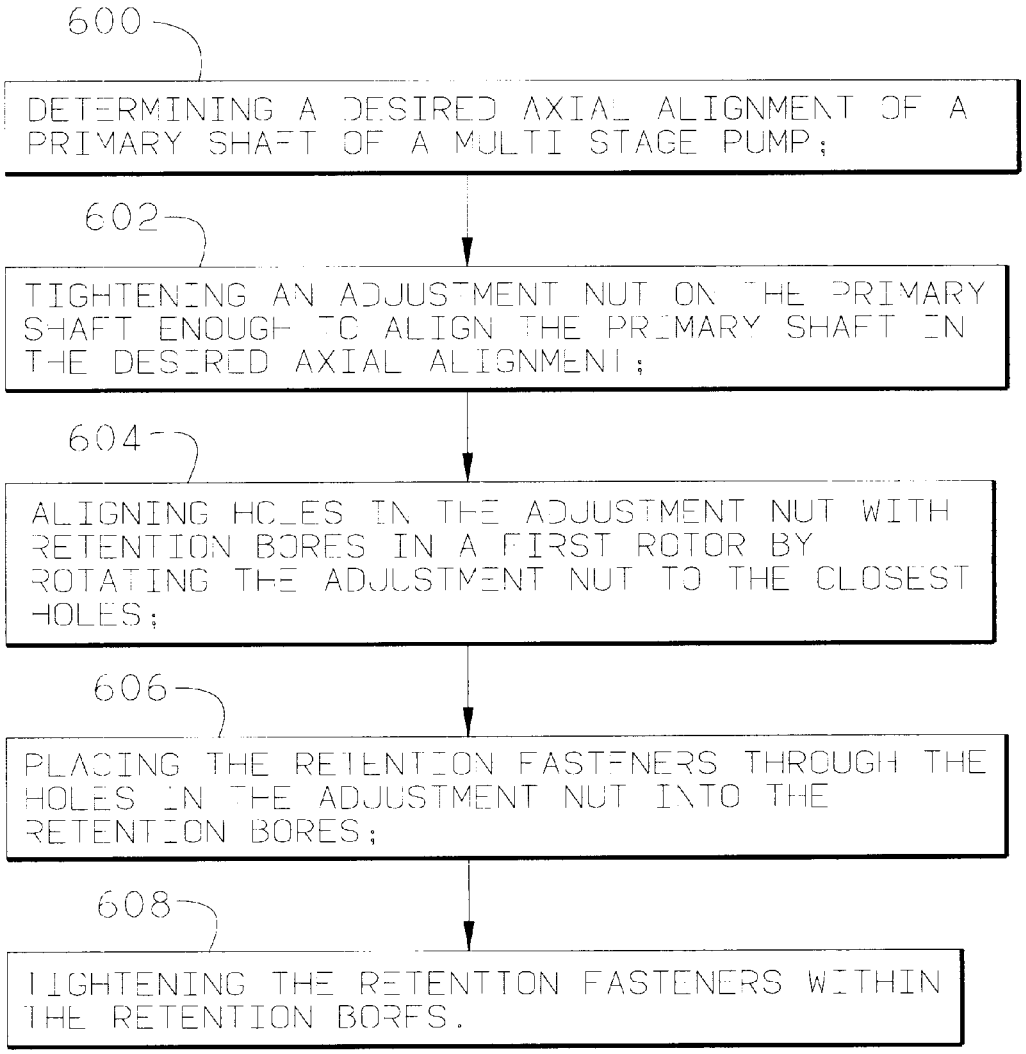
FIG. 6A is a flow chart illustrating the process for using the axial adjustment mechanism to align the primary shaft of the multi-stage pump.

FIG. 6A is a flow chart illustrating the use of the axial shaft adjustment means 42. First, in reference block 600 the desired axial position of the primary shaft 14 is determined. The desired axial position is generally approximately centered within the discharge chamber 30.

The center of the discharge chamber 30 is located by axially moving the primary shaft 14 to its axial limits and measuring the resultant, corresponding location of the primary shaft 14 at the axial limits. The axial limits of the primary shaft 14 can be determined by measuring the an axial gap between the thrust ring 54 and the impeller-like face 16 of first rotor 56 when the containment structure 84 is temporarily removed. In practice, the rest position of the primary shaft 14 is a lower limit, while an upper limit is measured by pulling upward on the shaft until the impellers 22 interfere with, or contact, the walls of the discharge chamber 30. The desired, axially-centered position of the primary shaft 14 and the impellers 22 is then extrapolated from the upper limit and the lower limit. A difference between the upper limit and the lower limit approximately equals the total axial shaft play. Approximately half of the total axial shaft play preferably represents the desired axial position. In alternate embodiments, a removable sight-plug or temporary probe may be positioned in the discharge chamber 30 or housing to view a sample alignment of the impeller 22 and to locate the desired axial position.

Second, in reference block 602 the adjustment nut 32 is tightened on the shaft threads 50 to align the primary shaft 14 and the associated impellers 22 in the desired axial position. The total axial shaft play is used to calculate the amount the adjustment nut 32 is tightened on the shaft threads 50 for the desired axial position. The total axial shaft play is divided by two and the adjustment nut 32 is preferably tightened on the shaft threads 50 to raise the primary shaft 14 and the associated impellers 22 by one-half of the total axial shaft play.

If, for example, the total axial shaft play is approximately one-eight of an inch from the upper limit to the lower limit, the primary shaft 14 should be adjusted by placing approximately one-sixteenth inch of clearance between the impellers 22 and their respective discharge chambers 30. In other words, the adjustment nut 32 would be tightened to lift the impellers 22 and the primary shaft 14 approximately one-sixteenth of an inch with respect to the impeller housing 12.

Third, in reference block 604 the holes 46 closest to the retention bores 52 are aligned with the retention bores 52 by rotating the adjustment nut 32. The adjustment nut 32 may be either tightened or loosened to achieve the alignment. The adjustment nut 32 is rotated the minimal possible amount to achieve the requisite alignment.

Fourth, in reference block 606 retention fasteners 48 are placed through the adjustment nut 32 and into the retention bores 52. Retention fasteners 48 are preferably positioned in holes 46 to balance the first rotor 56 for rotational operation. For example, the retention fasteners 48 may be placed approximately one-hundred and eight degrees apart in the holes 46 in a top side of the first rotor 56. The step in reference block 606 may comprise placing a primary fastener 500 into a first retention bore and a secondary fastener 502 into a second retention bore.

Finally, in reference block 608 the retention fasteners 48 are tightened within the retention bores 52. Therefore, the primary shaft 14 is locked in appropriate axial alignment with the impellers 22 approximately centered in their respective discharge chambers 30.

In the preferred embodiment, multiple retention fasteners 48 and multiple retention bores 52 are used. It is to be understood that the axial shaft adjustment means 42 may be practiced with a single retention fastener 48 and a single retention bore 52, instead of using multiple retention fasteners 48 and multiple bores 52.

Removal of the First Rotor from the Multi-stage Pump

Figure 6B:
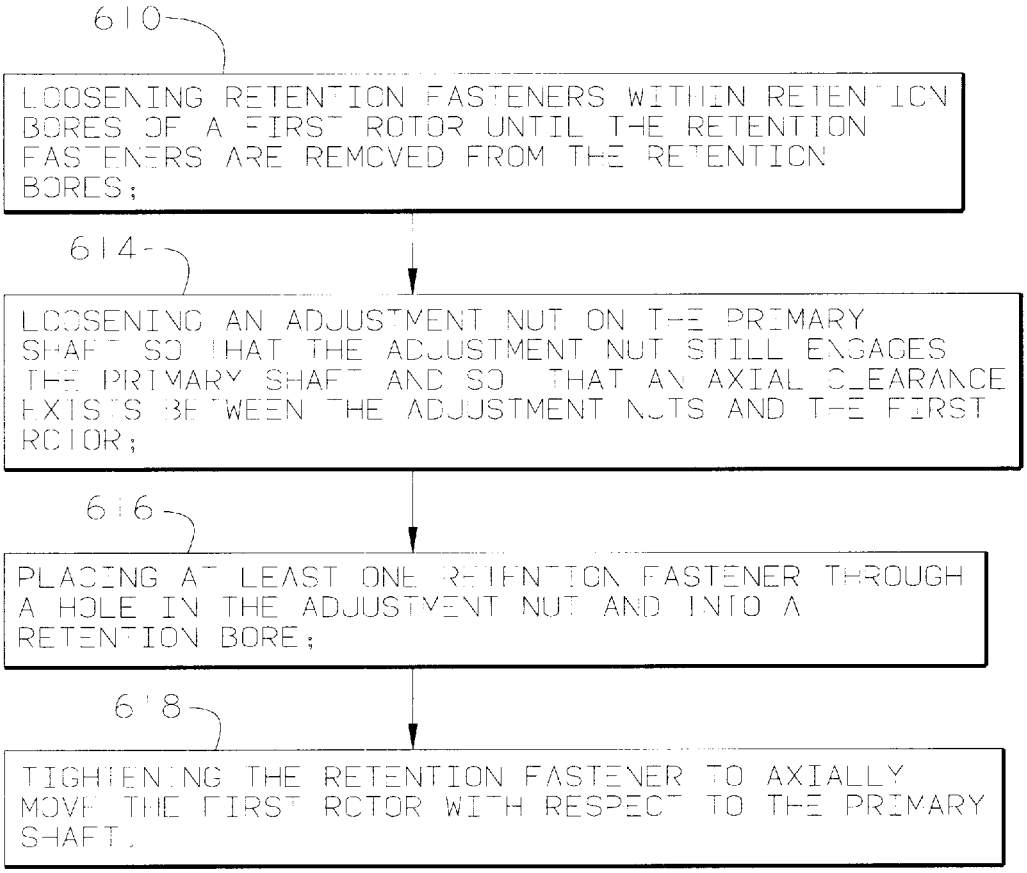
FIG. 6B is a flow chart illustrating the process for using the axial adjustment mechanism to remove the first rotor from the multi-stage pump.
Figure 7:
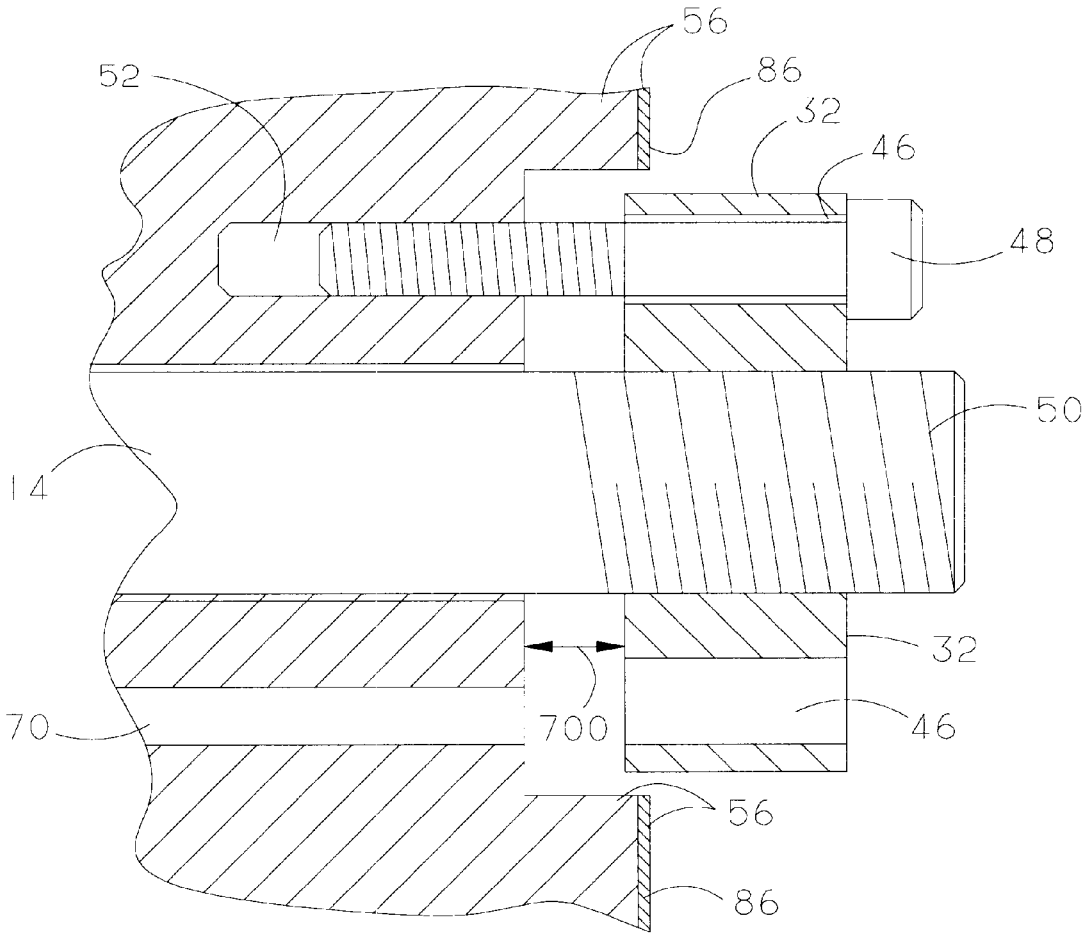
FIG. 7 is a cross-sectional view, of a portion of the magnetic-drive assembly, showing the removal of the first rotor from the primary shaft.

FIG. 6B and FIG. 7 relate to removing the first rotor 56 from the multi-stage pump 10. During normal operation, the first rotor 56 may be exposed to particulate matter, chemicals, and/or minerals in the pumped fluid. Residue from the chemicals, mineral deposits from pumped water, and particulate matter in the pumpage, may accumulate between the primary shaft 14 and the first rotor 56, potentially making disassembly difficult.

The axial adjustment means 42 of the preferred embodiment includes removal means for removing the first rotor 56 from the primary shaft 14. The removal means preferably includes an elongated primary shaft to increase or maximize an axial clearance 700 between the first rotor 56 and the adjustment nut 32. The removal means allows the magnetic-drive assembly 40 and the first rotor 56 to be removed from the multi-stage pump 10 without taking the whole multi-stage pump apart. In other words, the impeller assembly 20 may be left assembled while servicing the magnetic-drive assembly 40.

Starting in reference block 610 in FIG. 6B, the retention fasteners 48 within the retention bores 52 of the first rotor 56 are loosened so that the retention fasteners 48 are removed from the retention bores 52. In reference block 614, the adjustment nut 32 on the primary shaft 14 is loosened so that the adjustment nut 32 still engages the primary shaft 14 and so that an axial clearance 700 exists between the adjustment nut 32 and the first rotor 56. At least one retention fastener 48 is placed through a hole 46 into the retention bore 52 and tightened in reference block 618. As a result, the first rotor 56 moves axially upward and closes the axial clearance 700. The first rotor 56 is free to move axially upward until the first rotor 56 contacts the adjustment nut 32 and the axial clearance 700 becomes zero.

Once the first rotor 56 contacts the adjustment nut 32, a bolt or a threaded rod with threads that are the same size and pitch as the shaft threads 50 may be used to further remove the first rotor 56 from the multi-stage pump 10. The retention fastener 48 or retention fasteners 48 are loosed and removed. The bolt or threaded rod is placed in coaxial alignment with the primary shaft 14 so that the end of the primary shaft 14 contacts the end of the bolt. The adjustment nut 32 is placed on the bolt or threaded rod. The retention fastener 48 is placed in the hole 46 in the adjustment nut 32 and the bolt is tightened into the retention bores 52. Consequently, the first rotor 56 may be lifted out further than the primary shaft 14 alone would normally permit.

Second Embodiment of the Axial Shaft Adjustment Mechanism

Figure 8:
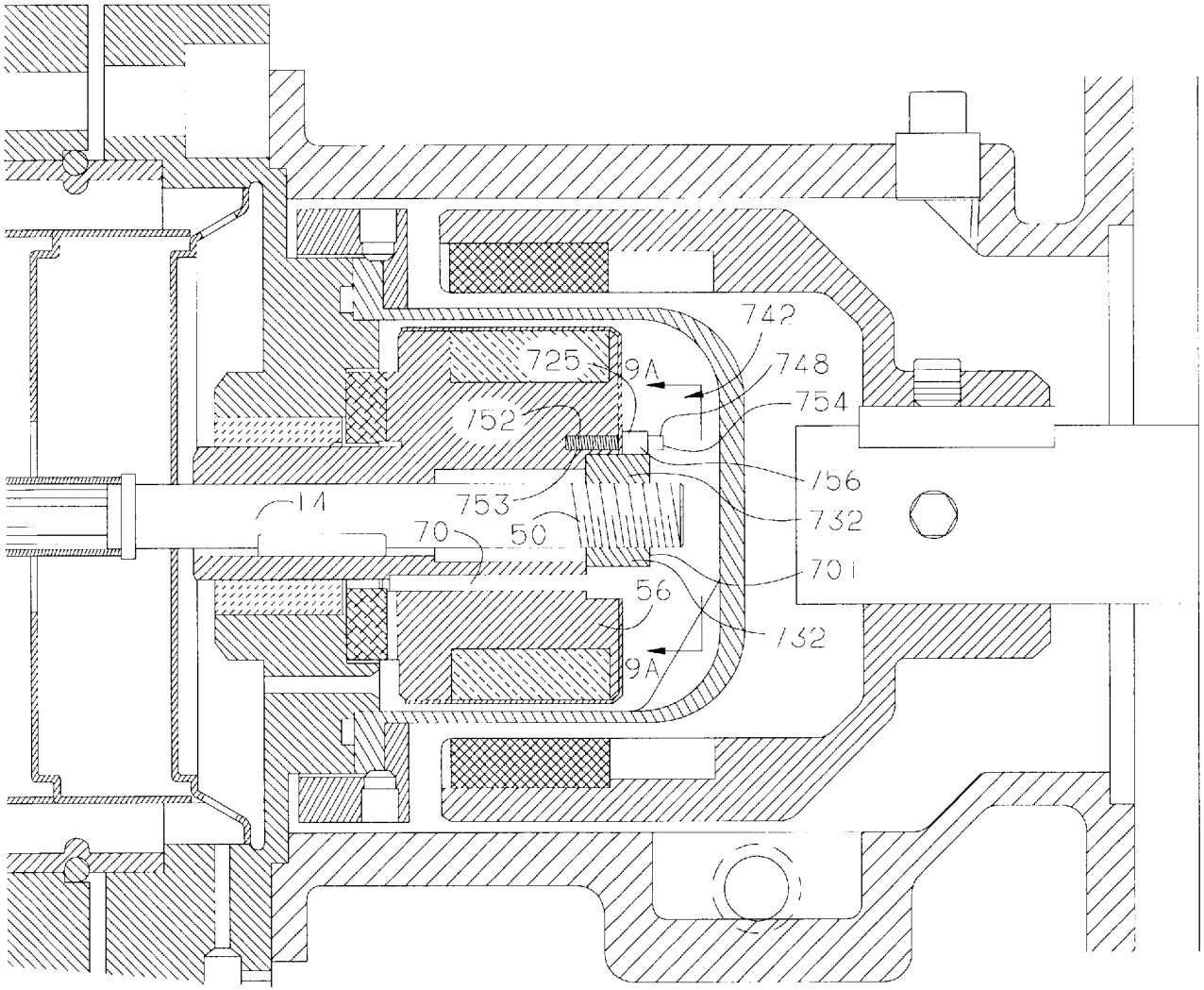
FIG. 8 is cross-sectional view of a second embodiment of the axial adjustment mechanism and the magnetic-drive assembly.
Figure 9A:
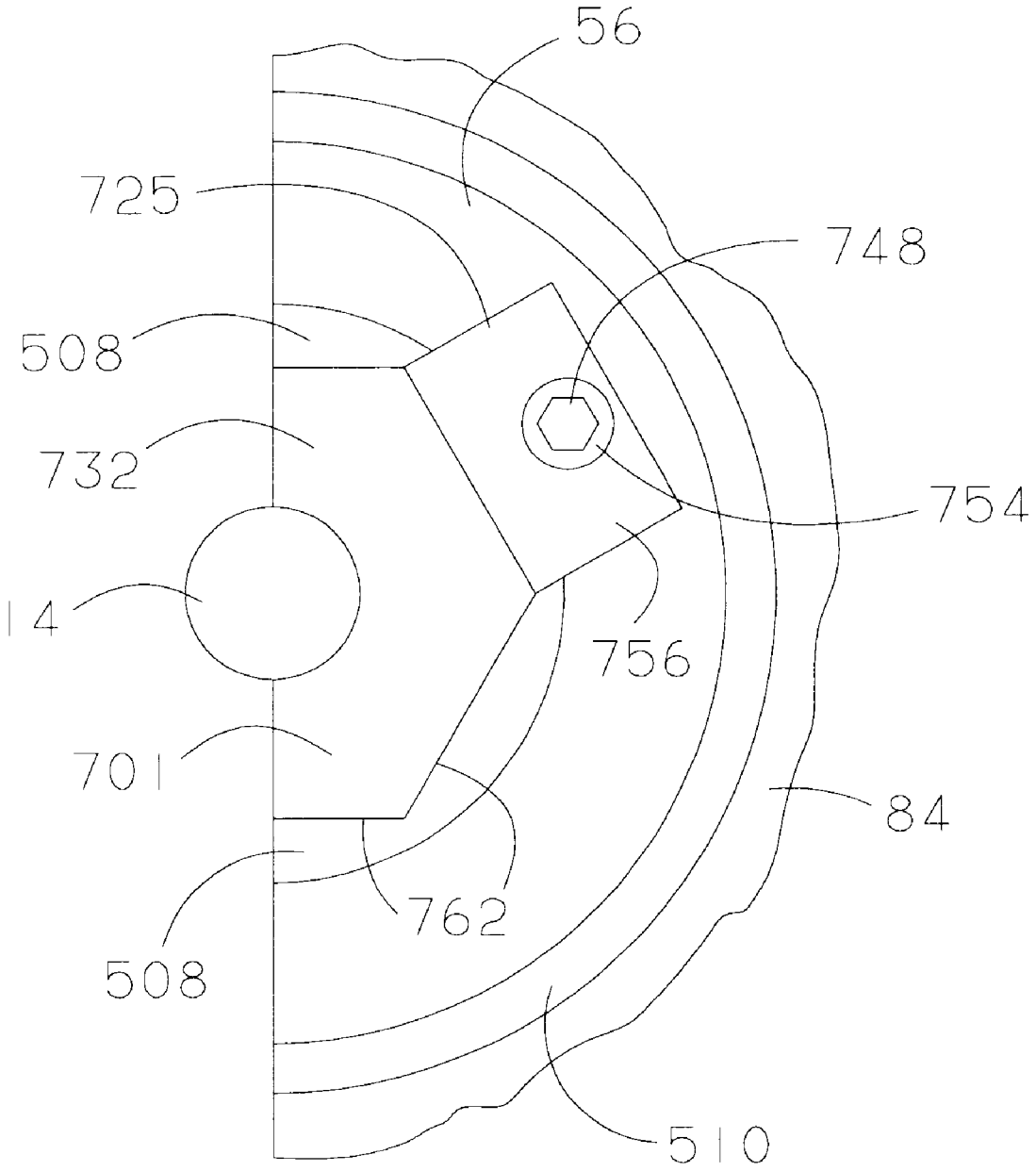
FIG. 9A is a plan view of a second embodiment of the axial adjustment mechanism along reference line 9A—9A of FIG. 8.
Figure 9B:
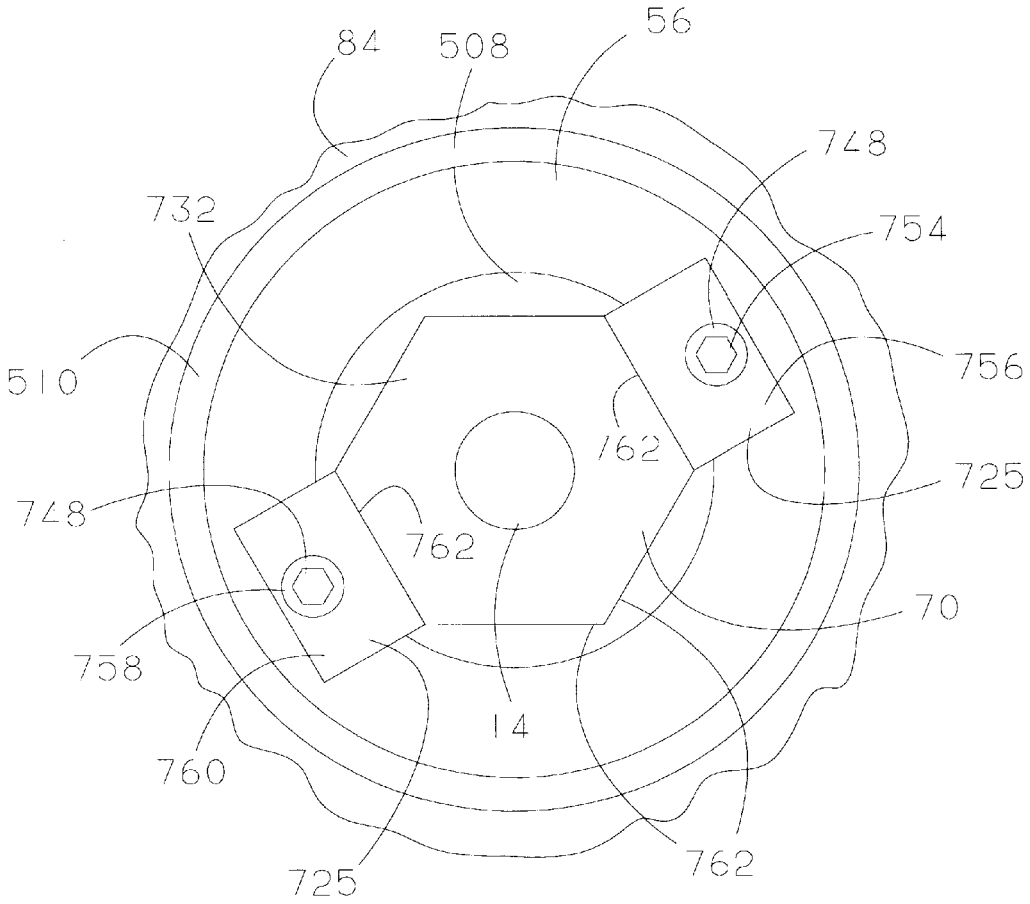
FIG. 9B illustrates an entire top side of the first rotor, as opposed to the cutaway portion of the first rotor shown in FIG. 9A.

FIG. 8, FIG. 9A and FIG. 9B show a second embodiment of the axial shaft adjustment mechanism 742. A top side of the first rotor 56 is shown with a radial gap 510 located between the first rotor 56 and the containment structure 84. The containment structure 84 is cut away and the remainder of the pump is deleted to simplify FIG. 9B. The interference members 725 contact sides 762 of the adjustment nut 732 after the adjustment nut 732 is adjusted for the proper axial alignment of the primary shaft 14 and the impellers 22 with respect to the housing. The adjustment nut 732 does not require holes in its face 701. The adjustment nut 732 is preferably located in a cylindrical recess 508 to reduce the axial profile of the axial adjustment mechanism 742.

The interference members 725 comprise rectangular blocks, polyhedron blocks, or a structures with shapes that conforms with the peripheral contour or side 762 of the adjustment nut 732 to prevent rotation of the adjustment nut 732. The peripheral contour signifies one or more sides 762 of the adjustment nut 732. Each interference member 725 preferably has an aperture for receiving a retention fastener 748. The interference members 725 are preferably held into place by placing retention fasteners 748 through the apertures into retention bores 752 (i.e. threaded bores) in the first rotor 56. Alternatively, the interference members 725 have no apertures and may be attached to the first rotor 56 by clips, retention rings, or snap-fit connectors, or the like.

As best illustrated in FIG. 9B, the first rotor 56 preferably has a plurality of interference members 725 connected to the first rotor 56 for balancing the first rotor 56. The interference members 725 include a first interference member 756 and a second interference member 760. The first interference member 756 is secured by a first fastener 754. The first fastener 754 engages the first rotor 56. The second interference member 760 is secured by a second fastener 758. The second fastener 758 engages the first rotor 56. The first interference member 756 and the second interference member 760 preferably contact opposite sides 762 of the adjustment nut 732 to prevent rotation of the adjustment nut 732.

Because the first interference member 756 and the second interference member 760 are preferably located approximately one-hundred and eighty degrees apart from each other, the first rotor 56 is rotationally balanced. If necessary, the interference members 725 may have different weights and relative orientations (i.e. relative angular and radial coordinates) and with respect to one another to balance the first rotor 56 for operational rotation. The distribution of the interference members 725 on the first rotor 56 or different weights of interference members 725 are preferred to provide adequate balancing for the first rotor 56. In alternate embodiments, ballast weights or material removal techniques may be used to balance the first rotor.

Alternate Embodiment of the Axial Bearing

Figure 10:
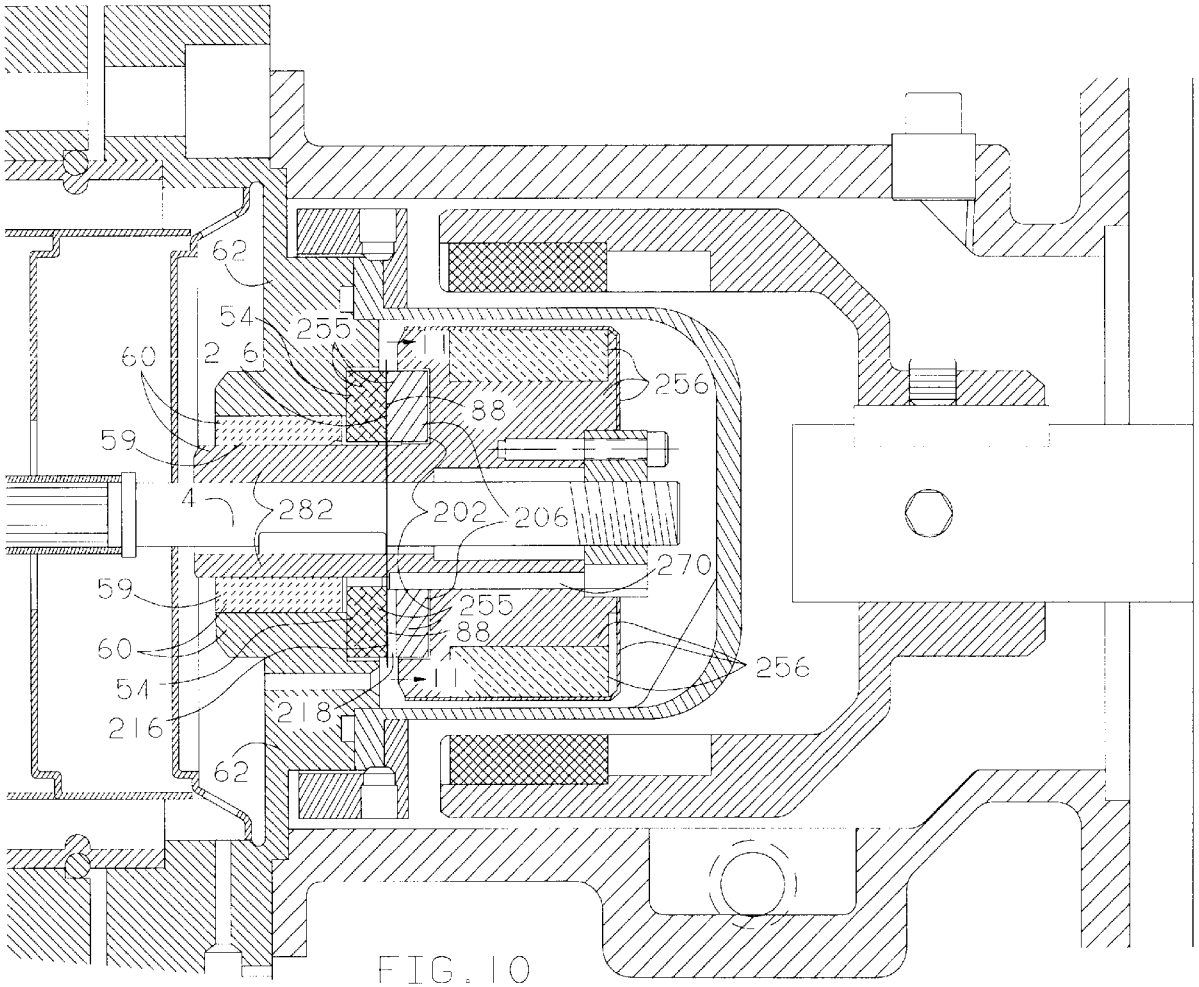
FIG. 10 is a cross-sectional view of an alternate embodiment of the magnetic-drive assembly in which the axial bearing has two discrete rings.
Figure 11:
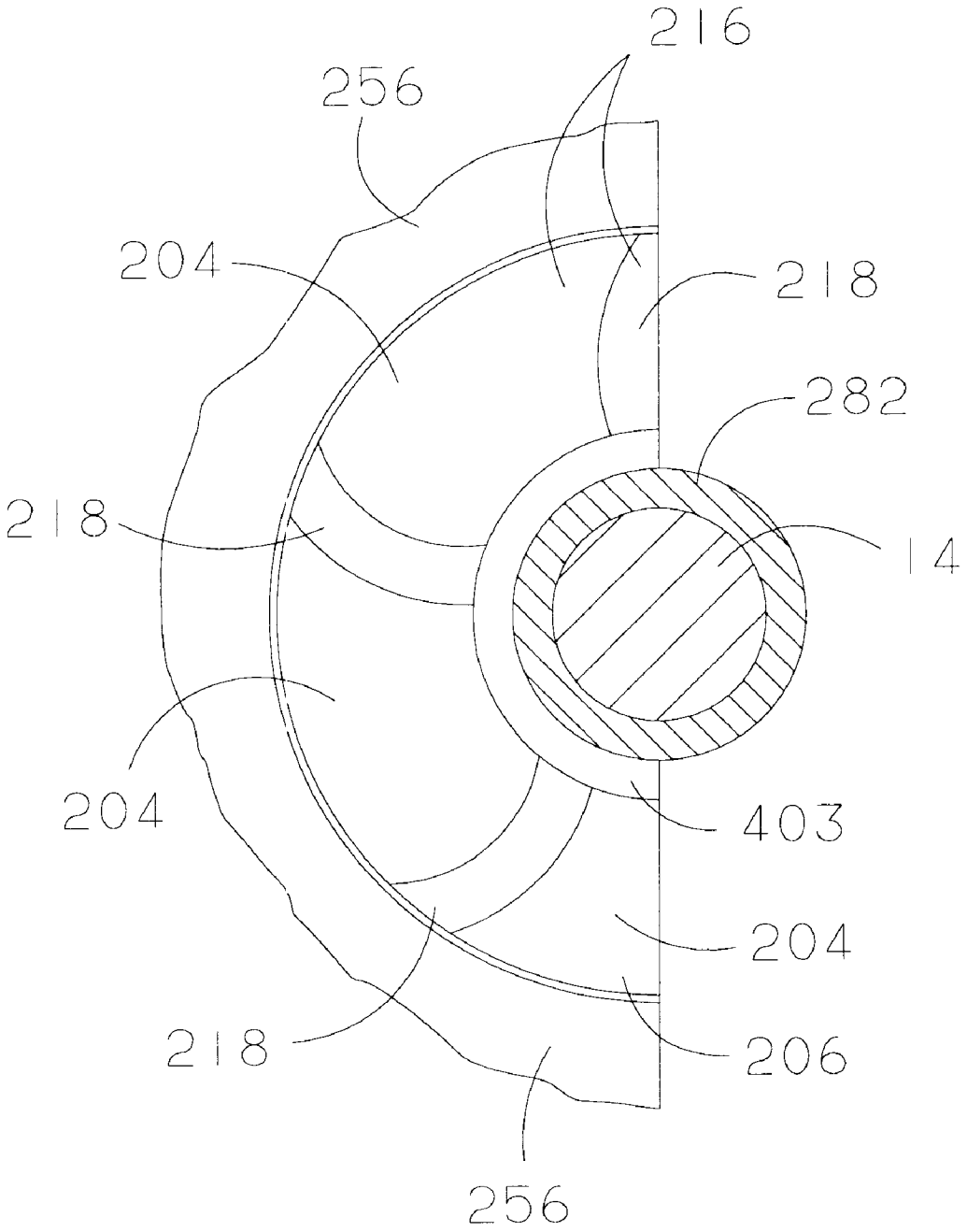
FIG. 11 shows a plan view of the impeller-like face of the axial bearing along reference line 11—11 of FIG. 10.

FIG. 10 and FIG. 11 illustrate an alternate embodiment of the axial bearing. The first rotor 256 has an annular recess 202 located on a bottom side of the first rotor 256. The annular recess 202 mates with an annular member 206. Together, the annular member 206 and the thrust ring 54 form an axial bearing 255. The annular member 206 is secured with respect to the first rotor 256 so that the annular member 206 and the first rotor 256 rotate simultaneously with each other. The thrust ring 54 is secured with respect to the bearing support 62. A mating face 88 of the thrust ring 54 faces an impeller-like face 216 of the annular member 206.

The impeller-like face 216 comprises a bearing face. The impeller-like face 216 has curved grooves 218, which may have a spiral or arched shape as best illustrated in FIG. 11. The curved grooves 218 are separated by lands 204. The aggregate surface area of the lands 204 is defined based on the load-carrying requirements of the axial bearing 255, as previously described in conjunction with the first embodiment of the magnetic-drive assembly. The volume of the curved grooves 218 is defined by the minimum acceptable efficiency of the pumping action of the impeller-like face 216. Optimally, the maximum groove depth of the grooves are approximately equal to the groove width of the grooves.

The first rotor 256 has a cylindrical projection 282. The cylindrical projection 282 surrounds the primary shaft 14.

An illustrative axial bearing 255 for a multi-stage pump with a best efficiency point of ten to thirty gallons per minute and ten to fifteen stages has the following preferred attributes: (a) a groove width and a groove depth of approximately one-quarter inch; (b) a diameter of the impeller-like face of approximately two to three inches; (c) four to six radial grooves separated by alternating lands.

The foregoing description is provided in sufficient detail to enable one of ordinary skill in the art to make and use the magnetic-drive assembly and multi-stage pump incorporating the magnetic-drive assembly. The foregoing detailed description is merely illustrative of several physical embodiments of the magnetic-drive assembly and its associated features. Physical variations of the magnetic-drive assembly and the multi-stage pump incorporating the magnetic-drive assembly, not fully described in the specification, are encompassed within the purview of the claims. Accordingly, the narrow description of the elements in the specification should be used for general guidance rather than to unduly restrict the broader descriptions of the elements in the following claims.

We claim:

1. A magnetic-drive assembly for a multi-stage, centrifugal pump having a primary shaft, the assembly comprising:

a housing having a bearing support;

a containment structure associated with the housing;

a first rotor located on a wet side of the containment structure, the first rotor coupled to the primary shaft for rotation with the primary shaft;

a second rotor located on a dry side of the containment structure, the second rotor magnetically coupled to the first rotor;

a bushing supported by the bearing support, the bushing being associated with the primary shaft;

a thrust ring disposed between the first rotor and the bearing support;

axial adjustment means for adjusting an axial position of the primary shaft with respect to the housing, the axial adjustment means redundantly securing the orientation of an adjustment nut upon the primary shaft.

2. The magnetic-drive assembly according to claim 1 wherein the axial adjustment means comprises retention fasteners and holes in the adjustment nut; the adjustment nut having holes positioned in a face of the adjustment nut, the holes having axes approximately parallel to a longitudinal axis of the primary shaft; the retention fasteners being placed through the corresponding holes, and the retention fasteners extending into the first rotor.

3. The magnetic-drive assembly of claim 2 wherein the retention fasteners comprise bolts and wherein the adjustment nut is substantially cylindrical with a knurled periphery.

4. The magnetic-drive assembly according to claim 1 wherein the axial adjustment means comprises retention fasteners and holes in the adjustment nut; the adjustment nut having holes positioned in a face of the nut, the holes having axes approximately parallel to a longitudinal axis of the primary shaft, the retention fasteners being placed through select ones of the holes so that the first rotor is rotationally balanced, the retention fasteners extending into the first rotor.

5. The magnetic-drive assembly according to claim 4 wherein two of said retention fasteners are positioned approximately one-hundred and eighty degrees apart with respect to a top side of the first rotor.

6. The magnetic-drive assembly according to claim 1 wherein the axial adjustment means comprises a primary fastener, a secondary fastener, threaded bores in the first rotor, and holes in the adjustment nut; the adjustment nut having holes radially positioned in a face of the adjustment nut, the holes having axes substantially parallel to a longitudinal axis of the primary shaft, the primary fastener being placed through one of said holes after the axial position of the primary shaft is adjusted, the secondary fastener being placed through another one of said holes after the axial position of the primary shaft is adjusted, the first rotor having the threaded bores extending axially into the first rotor, the threaded bores arranged for receiving the primary fastener and the secondary fastener.

7. The magnetic-drive assembly according to claim 6 wherein the holes comprise four holes radially positioned at approximately ninety degree intervals in the face of the adjustment nut.

8. The magnetic-drive assembly according to claim 7 wherein the primary fastener and the secondary fastener are positioned approximately one-hundred and eighty degrees apart with respect to a top side of the first rotor.

9. The magnetic-drive assembly according to claim 1 wherein the axial adjustment means comprises interference members placed adjacent to at least two sides of the adjustment nut, the interference members engaging the adjustment nut, the interference members being fastened to the first rotor, the interference members interfering with the rotation of the adjustment nut with respect to the primary shaft.

10. The magnetic-drive assembly according to claim 9 wherein the interference members have different weights and relative orientations with respect to one another, said different weights and said relative orientations selected to balance the first rotor for operational rotation.

11. The magnetic-drive assembly according to claim 9 wherein the interference members include a first interference member and a second interference member, the first interference member having one aperture, the second interference member having another aperture, a first fastener extending through the aperture in the first interference member and into the first rotor, and a second fastener extending through the aperture in the second interference member and into the first rotor.

12. The magnetic-drive assembly according to claim 11 wherein the first interference member and the second interference member are approximately the same size and wherein the first interference member and the second interference member are positioned approximately one-hundred and eighty degrees apart from each other.

13. A magnetic-drive assembly for a multi-stage, centrifugal pump having a primary shaft, the assembly comprising:

a housing having a bearing support, a containment structure associated with the housing;

a first rotor located on a wet side of the containment structure, the first rotor coupled to the primary shaft for rotation with the primary shaft;

a second rotor located on a dry side of the containment structure, the second rotor magnetically coupled to the first rotor:

a bushing supported by the bearing support, the bushing being associated with the primary shaft;

a thrust ring disposed between the first rotor and the bearing support;

axial adjustment means for adjusting the axial position of the primary shaft with respect to the housing, the axial adjustment means including removal means for partially or completely removing the first rotor from the primary shaft, wherein the removal means comprises a fastener, a nut having holes, and bores in the first rotor; the nut having holes positioned in a face of the nut, the holes having axes approximately parallel to a longitudinal axis of the primary shaft, the primary shaft having a minimum shaft length for an axial clearance located between the first rotor and the nut, and the fastener being placed through one of said holes and into one of said bores.

14. A magnetic-drive assembly for a multi-stage, centrifugal pump having a primary shaft, the assembly comprising:

a housing having a bearing support, a containment structure associated with the housing;

a first rotor located on a wet side of the containment structure, the first rotor coupled to the primary shaft for rotation with the primary shaft;

a second rotor located on a dry side of the containment structure, the second rotor magnetically coupled to the first rotor;

a bushing supported by the bearing support, the bushing being associated with the primary shaft;

a thrust ring disposed between the first rotor and the bearing support;

axial adjustment means for adjusting the axial position of the primary shaft with respect to the housing, the axial adjustment means including removal means for partially or completely removing the first rotor from the primary shaft, wherein the removal means comprises a primary fastener, a secondary fastener, a nut having holes, and threaded bores located in the first rotor; the nut having holes in a face of the nut, the nut engaging threads on the primary shaft, the primary shaft having a minimum shaft length for an axial clearance between the first rotor and the nut, the primary fastener and the secondary fastener engaging said threaded bores, the primary fastener and the secondary fastener placing axial forces upon the first rotor when the first fastener and the secondary fastener are tightened.

15. The magnetic-drive assembly of claim 13 wherein the fastener is selected from the group of fasteners comprising a threaded member, a screw, and a bolt.

16. The magnetic-drive assembly according to claim 14 wherein the primary fastener and the secondary fastener are positioned approximately 180 degrees apart with respect to a top side of the first rotor.

17. A magnetic-drive assembly for a multi-stage, centrifugal pump having a primary shaft, the magnetic-drive assembly comprising:

a housing having a bearing support, a containment structure cooperating with the housing to confine any pumped fluid to a wet side of the containment structure;

a first rotor located on the wet side of the containment structure, the first rotor coupled to the primary shaft for rotation with the primary shaft, the first rotor having magnets arranged about its periphery, the first rotor having a sleeve-like, cylindrical projection extending axially from the first rotor, the cylindrical projection connected to the primary shaft, the first rotor having bores extending axially into the first rotor;

a second rotor located on a dry side of the containment structure, the second rotor magnetically coupled to the first rotor, the second rotor having magnets;

a bushing supported by the bearing support, the bushing being associated with the primary shaft;

a thrust ring interposed between a bearing face of the first rotor and the bearing support;

an adjustment nut located on said primary shaft, the adjustment nut having holes extending axially through a face of the adjustment nut;

a primary retention fastener extending through one of said holes and into the first rotor.

18. The magnetic-drive assembly according to claim 17 further comprising a secondary retention fastener; the primary retention fastener and the secondary retention fastener being placed through select ones of the holes so that the first rotor is rotationally balanced, the primary retention fastener and secondary retention fastener extending into the first rotor.

19. The magnetic-drive assembly according to claim 18 wherein the primary retention fastener and the secondary retention fastener are positioned approximately one-hundred and eighty degrees apart with respect to the first rotor.

20. The magnetic-drive assembly according to claim 17 further comprising a secondary fastener and threaded bores in the first rotor; the adjustment nut having said holes radially positioned in a face of the adjustment nut, the holes having axes substantially parallel to a longitudinal axis of the primary shaft, the primary fastener being placed through one of said holes after an axial position of the primary shaft is adjusted, the secondary fastener being placed through another one of said holes after the axial position of the primary shaft is adjusted, the first rotor having threaded bores extending axially into the first rotor, the threaded bores arranged for mating with the primary fastener and the secondary fastener.

21. The magnetic-drive assembly according to claim 20 wherein the holes comprise four holes radially positioned at approximately ninety degree intervals in the face of the adjustment nut.

22. The magnetic-drive assembly according to claim 20 wherein the primary fastener and the secondary fastener are positioned approximately 180 degrees apart with respect to a top side of the first rotor.

23. A centrifugal multi-stage pump comprising:

a primary shaft;

a housing having a bearing support, the bearing support radially extending toward a pump interior, the housing having discharge chambers and intake chambers;

a containment structure associated with the housing, the housing cooperating with the containment structure to confine any pumped fluid to a wet side;

a first rotor located on the wet side of the containment structure, the first rotor coupled to the primary shaft for rotation with the primary shaft, the first rotor having an impeller-like face;

a second rotor located on a dry side of the containment structure, the second rotor magnetically coupled to the first rotor;

impellers located in the discharge chambers and coupled to the primary shaft, a majority of the impellers having their impeller intakes facing downward;

a radial bearing located within the housing, the radial bearing being associated with the primary shaft;

a thrust ring disposed between the first rotor and the bearing support, the thrust ring and the impeller-like face cooperating to handle downward axial forces, the thrust ring and impeller-like face placing primarily tensile forces on the shaft in response to the downward axial forces from the impellers; and axial adjustment means for adjusting and securing the axial position of the primary shaft with respect to the housing, the axial adjustment means redundantly securing the orientation of an adjustment nut upon the primary shaft.

24. The centrifugal multi-stage pump of claim 23 wherein the impeller-like face has alternating radial grooves and lands, the lands located adjacent to the radial grooves, the lands forming a load-bearing face for axial loads with respect to the thrust ring.

25. The centrifugal multi-stage pump of claim 24 wherein an aggregate surface area of the lands is selected to be equal to or greater than a minimum aggregate surface area required to meet estimated maximum downward axial forces, considering the material composition and compressive properties of the thrust ring and the impeller-like face.

26. The centrifugal multi-stage pump of claim 24 wherein the radial grooves have groove cross sections, the groove cross sections having shapes selected from the group of arched contours, semi-circular contours, semi-elliptical contours, V-shaped contours, and U-shaped contours.

27. The centrifugal multi-stage pump of claim 24 wherein the radial grooves have a maximum groove depth and a groove width, the maximum groove depth approximately equaling the groove width.

28. The centrifugal multi-stage pump of claim 23 wherein the impeller-like face has a diameter of two to three inches; and wherein the impeller-like face has four to six radial grooves with a groove depth of approximately one-quarter of an inch and a groove width of approximately one-quarter of an inch.

29. The centrifugal multi-stage pump according to claim 28 wherein the centrifugal pump has a best efficiency point ranging approximately from ten to thirty gallons per minute and wherein the centrifugal pump contains ten to fifteen stages.

30. The centrifugal multi-stage pump according to claim 23 wherein all of the intakes of the impellers are facing downward.

31. The centrifugal multi-stage pump according to claim 23 wherein the impeller-like face is coated with chrome oxide and wherein the thrust ring is made from carbon graphite.

32. The centrifugal multi-stage pump according to claim 23 wherein the radial bearing is stationary with respect to the thrust ring, the radial bearing located adjacent to the thrust ring; the thrust ring secured to the bearing support, relative sliding movement or rotational movement occurring between the impeller-like face and the thrust ring.

33. A centrifugal multi-stage pump comprising:

a primary shaft;

a housing having a bearing support, the bearing support radially extending toward a pump interior, the housing having discharge chambers and intake chambers;

a containment structure cooperating with the housing to confine any pumped fluid to a wet side of the pump;

a first rotor located on the wet side of the containment structure, the first rotor coupled to the primary shaft for rotation with the primary shaft, the first rotor having an bearing face with alternating lands and grooves;

a second rotor located on a dry side of the containment structure, the second rotor magnetically coupled to the first rotor;

impellers located in the discharge chambers and coupled to the primary shaft, a majority of the impellers having their intakes facing downward;

a radial bearing located within the housing, the radial bearing being associated with the primary shaft and having a bushing;

a thrust ring disposed between the first rotor and the bearing support, the thrust ring and the bearing face cooperating to handle downward axial forces, the thrust ring and bearing face placing primarily tensile forces on the shaft in response to downward axial forces from the impellers; and axial adjustment means for adjusting the axial position of the primary shaft with respect to the housing, the axial adjustment means redundantly securing the orientation of an adjustment nut upon the primary shaft.

34. The centrifugal multi-stage pump according to claim 33 wherein the bearing face has an inner radial boundary and an outer radial boundary, the first rotor having a substantially annular depression located adjacent to the inner radial boundary; the inner radial boundary and the first rotor forming boundaries of an annular inlet region, the annular inlet region being in fluidic communication with the grooves located in the bearing face.

35. The centrifugal multi-stage pump according to claim 33 wherein the thrust ring has a cylindrical inner surface and a cylindrical outer surface, the cylindrical inner surface defining a boundary of an annular inlet region, the annular inlet region being in fluidic communication with the grooves located in the bearing face.

36. The centrifugal pump according to claim 33 wherein the grooves extend substantially radially in the bearing face.

37. The centrifugal pump according to claim 33 wherein the grooves approximately form a spiral in the bearing face.

38. The centrifugal pump according to claim 33 wherein the grooves are partially radially extending and substantially arched.

39. The centrifugal pump according to claim 33 wherein the bearing face rotates and induces a suction or a radial bearing flow in an annular gap adjacent to the bushing.

40. The centrifugal pump according to claim 33 wherein the bearing face rotates and induces a suction or a radial bearing flow in an annular gap interposed between the bushing and a sleeve-like cylindrical projection of the first rotor.

41. The centrifugal pump according to claim 33 wherein the bearing support has a first channel extending substantially axially through the bearing support to fluidly connect a magnetic-drive region to a discharge region, the first channel providing one fluid path for fluid radially exiting the grooves, and another fluid path provided by a radial gap between the first rotor and the containment structure.

42. The centrifugal pump according to claim 33 wherein relative movement between the thrust ring and the bearing face induces a flow of fluid in a primary fluid path; the primary fluid path having a radial bearing flow, a pumping region flow, a first channel flow, and a radial gap flow; the radial bearing flow induced by a suction from the rotating grooves of the bearing face, the radial bearing flow moving upward toward the bearing face; the radial bearing flow entering an annular inlet region, the pumping region flow moving fluid radially outward from the annular inlet region to an annular outlet region, the first channel flow and the radial gap flow induced by pressurized fluid in the annular outlet region, the fluid exiting the first channel combining with a main flow of the centrifugal pump.

43. The centrifugal pump according to claim 41 wherein the first rotor has a second channel located in the first rotor and extending axially through the first rotor, a rotation of the grooves in the bearing face inducing a second channel flow in the second channel.

44. The centrifugal pump according to claim 43 wherein relative movement between the thrust ring and bearing face induces a flow of fluid in a secondary fluid path; the secondary fluid path having a second channel flow, a pumping region flow, a first channel flow, a radial gap flow, and a return flow; the second channel flow induced by a suction from the bearing face, the second channel flow moving downward toward the bearing face; the second channel flow entering an annular inlet region, the pumping region flow moving fluid radially outward from the annular inlet region to an annular outlet region, the radial gap flow and the first channel flow induced by pressurized fluid in the annular outlet region, the fluid exiting the radial gap flow forming the return flow to the second channel.

45. The centrifugal pump of claim 33 wherein the thrust ring is over-sized and wherein an annular inlet region is formed by the thrust ring with an inner cylindrical radius which substantially exceeds a shaft radius of the primary shaft.

46. The centrifugal pump according to claim 33 wherein the first rotor is coated with chrome oxide and wherein the thrust ring is made from carbon graphite.

47. The centrifugal pump according to claim 33 wherein the bearing face includes an annular member located in the first rotor, the first rotor having a substantially annular recess for mounting the annular member.

48. The centrifugal pump according to claim 33 wherein a first portion of the primary shaft is located in a magnetic-drive assembly and a second portion of the primary shaft is located in the impeller housing; the magnetic drive assembly having no thrust bearing that handles an upward thrust force on the primary shaft.

49. A method for adjusting an axial displacement of a primary shaft in a multi-stage centrifugal pump with respect to a housing of the multi-stage centrifugal pump, the housing containing impellers and associated discharge chambers; the method comprising the steps of:

a) determining a desired axial position of the primary shaft of a multi-stage pump;

b) tightening an adjustment nut on the primary shaft enough to align the primary shaft in a desired axial direction;

c) aligning holes in the adjustment nut with retention bores in a first rotor by rotating the adjustment nut a minimal possible amount;

d) placing retention fasteners through the holes in the adjustment nut and into the retention bores; and e) tightening the retention fasteners within the retention bores.

50. The method according to claim 49 wherein step a of determining the desired axial position further includes the steps of:

i) measuring a first axial displacement of the primary shaft relative to the housing in a rest position at a lower limit; and ii) measuring a second axial displacement of the primary shaft relative to the housing in a lifted position of the primary shaft at an upper limit such that the impellers contact walls of the discharge chambers.

51. The method according to claim 50 wherein the first axial displacement and the second axial displacement are measured by removing a containment structure of the multi-stage centrifugal pump and measuring distances between a thrust ring and the first rotor at the upper limit and the lower limit.

52. The method according to claim 50 wherein the step b of tightening the adjustment nut on the primary shaft further comprises the steps of:

i) determining a difference or distance between the upper limit of axial shaft displacement and the lower limit of axial shaft displacement, the difference approximately equaling total axial shaft play;

ii) dividing the total axial shaft play by two to obtain a desired axial adjustment; and iii) tightening the adjustment nut in step b enough to raise the primary shaft by two of the desired axial adjustment.

53. The method of claim 49 wherein step d of placing retention fasteners through the adjustment nut includes first positioning the retention fasteners to balance a first rotor for rotational operation.

* * * * *